US011225861B1

(12) United States Patent
Dille et al.

(10) Patent No.: US 11,225,861 B1
(45) Date of Patent: Jan. 18, 2022

(54) FLUID END BLOCK FOR FRAC PUMP

(71) Applicant: KHOLLE Magnolia 2015, LLC, Houston, TX (US)

(72) Inventors: Mark C. Dille, Magnolia, TX (US); Larry Mitchell Hill, Cypress, TX (US); William Brent Stroebel, Houston, TX (US); Scott Taylor Donaldson, Spring, TX (US); E. Lee Colley, III, Jersey Village, TX (US)

(73) Assignee: KHOLLE Magnolia 2015, LLC, Houston, TX (US)

( * ) Notice: Subject to any disclaimer, the term of this patent is extended or adjusted under 35 U.S.C. 154(b) by 77 days.

(21) Appl. No.: 16/549,568

(22) Filed: Aug. 23, 2019

(51) Int. Cl.

| | |
|---|---|
| ***E21B 43/267*** | (2006.01) |
| ***F04B 1/182*** | (2020.01) |
| ***F04B 19/22*** | (2006.01) |
| ***F04B 53/10*** | (2006.01) |
| *F04B 1/16* | (2006.01) |
| *F04B 1/143* | (2020.01) |
| *F04B 1/145* | (2020.01) |
| *F04B 1/184* | (2020.01) |

(52) U.S. Cl.
CPC ..... *E21B 43/267* (2013.01); *F04B 1/182* (2013.01); *F04B 19/22* (2013.01); *F04B 53/1027* (2013.01); *F04B 1/143* (2013.01); *F04B 1/145* (2013.01); *F04B 1/16* (2013.01); *F04B 1/184* (2013.01)

(58) Field of Classification Search
CPC ..... E21B 43/267; F04B 1/182; F04B 1/143; F04B 1/145; F04B 1/16; F04B 1/184; F04B 19/22; F04B 53/1027
USPC ..... 166/308.1
See application file for complete search history.

(56) References Cited

U.S. PATENT DOCUMENTS

| | | | | |
|---|---|---|---|---|
| 6,910,871 | B1 * | 6/2005 | Blume | F04B 53/007 137/512 |
| 7,186,097 | B1 | 3/2007 | Blume | |
| 8,147,227 | B1 | 4/2012 | Blume | |
| 9,188,121 | B1 | 11/2015 | Dille | |
| 9,297,375 | B1 | 3/2016 | Dille | |
| 9,435,454 | B2 | 9/2016 | Blume | |
| 2012/0288387 | A1 | 11/2012 | Freed et al. | |
| 2016/0208797 | A1 * | 7/2016 | Ladd | F04B 53/162 |
| 2019/0011051 | A1 * | 1/2019 | Yeung | E21B 43/26 |
| 2019/0154033 | A1 * | 5/2019 | Brooks | F04B 53/1087 |
| 2021/0040945 | A1 * | 2/2021 | Hurst | E21B 41/00 |

* cited by examiner

*Primary Examiner* — Matthew R Buck
*Assistant Examiner* — Patrick F Lambe
(74) *Attorney, Agent, or Firm* — Keith B. Willhelm

(57) ABSTRACT

Frac pumps have a fluid end and a fluid end block. The fluid end block has a plunger cylinder having a primary axis, a suction bore having a primary axis, a discharge bore, and a pump chamber. The pump chamber is defined by the intersection of the plunger cylinder, the suction bore, and the discharge bore. The fluid end block has a cylindrical portion extending along the primary axis of the suction bore. The cylindrical portion has a diameter greater than the diameter of the plunger cylinder. The pump chamber also has a ridge that extends radially inward from the walls of the pump chamber in a plane normal to the suction bore primary axis.

20 Claims, 17 Drawing Sheets

FLUID END BLOCK FOR FRAC PUMP

FIELD OF THE INVENTION

The present invention relates in general to high pressure, high volume reciprocating pumps used in the oil and gas industry to fracture or "frac" a formation, and in particular, to improved designs for the fluid ends of such pumps.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer. Thus, the porous layer forms a reservoir, that is, a volume in which hydrocarbons accumulate. A well is drilled through the earth until the hydrocarbon bearing formation is reached. Hydrocarbons then can flow from the porous formation into the well.

In what is perhaps the most basic form of rotary drilling methods, a drill bit is attached to a series of pipe sections referred to as a drill string. The drill string is suspended from a derrick and rotated by a motor in the derrick. A drilling fluid or "mud" is pumped down the drill string, through the bit, and into the well bore. This fluid serves to lubricate the bit and carry cuttings from the drilling process back to the surface. As the drilling progresses downward, the drill string is extended by adding more pipe sections.

A modern oil well typically includes a number of tubes extending wholly or partially within other tubes. That is, a well is first drilled to a certain depth. Larger diameter pipes, or casings, are placed in the well and cemented in place to prevent the sides of the borehole from caving in. After the initial section has been drilled, cased, and cemented, drilling will proceed with a somewhat smaller well bore. The smaller bore is lined with somewhat smaller pipes or "liners." The liner is suspended from the original or "host" casing by an anchor or "hanger." A well may include a series of smaller liners, and may extend for many thousands of feet, commonly up to and over 25,000 feet.

Hydrocarbons, however, are not always able to flow easily from a formation to a well. Some subsurface formations, such as sandstone, are very porous. Hydrocarbons can flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations. In particular, various techniques are available for increasing production from formations which are relatively nonporous.

Perhaps the most important stimulation technique is the combination of horizontal well bores and hydraulic fracturing. A well will be drilled vertically until it approaches a formation. It then will be diverted, and drilled in a more or less horizontal direction, so that the borehole extends along the formation instead of passing through it. More of the formation is exposed to the borehole, and the average distance hydrocarbons must flow to reach the well is decreased. Fractures then are created in the formation which will allow hydrocarbons to flow more easily from the formation.

Fracturing a formation is accomplished by pumping fluid, most commonly water, into the well at high pressure and flow rates. Proppants, such as grains of sand, ceramic or other particulates, usually are added to the fluid along with gelling agents to create a slurry. The slurry is forced into the formation at rates faster than can be accepted by the existing pores, fractures, faults, vugs, caverns, or other spaces within the formation. Pressure builds rapidly to the point where the formation fails and begins to fracture. Continued pumping of fluid into the formation will tend to cause the initial fractures to widen and extend further away from the well bore, creating flow paths to the well. The proppant serves to prevent fractures from closing when pumping is stopped.

A formation rarely will be fractured all at once. It typically will be fractured in many different locations or zones and in many different stages. Fluids will be pumped into the well to fracture the formation in a first zone. After the initial zone is fractured, pumping is stopped, and a plug is installed in the liner at a point above the fractured zone. Pumping is resumed, and fluids are pumped into the well to fracture the formation in a second zone located above the plug. That process is repeated for zones further up the formation until the formation has been completely fractured.

The harsh operating conditions and frequent servicing means that the typical fracturing operation rarely relies on a single pump. It is important that the operation continue uninterrupted once it has been initiated. If there is a significant pressure drop before the required volume of proppant has been injected into a formation, the formation will tend to relax and close the fractures. Operators, therefore, typically use an array of frac pumps connected in parallel to a common flow line. The array provides excess capacity so that, if necessary, individual pumps may be taken off-line for repair or service without having to stop the overall operation. That excess capacity, however, has its own cost, which can be reduced only to the extent that the likelihood of any individual pump failing or requiring service during the frac operation is reduced.

Frac pumps used in the oil and gas industry are of the type referred to as reciprocating plunger pumps. They typically incorporate a number of synchronized and manifolded pumping units, usually three (a "triplex" pump) or five (a "quintiplex" pump). Each pumping unit has a plunger that moves linearly back and forth in a cylinder, traveling in and out of a pump chamber. The pump chamber communicates with an intake or "suction" port and a discharge port. Each port has a one-way valve. Fluid enters the chamber through the intake port as the plunger withdraws from the chamber. It is pumped out of the chamber through the discharge port as the plunger enters the chamber.

The plungers are part of what is generally referred to as the "fluid end" of the pump. They are driven by what is commonly referred to as the "power end" of the pump. The power end includes a rotating crankshaft that typically is powered by a diesel engine. The rotation of the crankshaft is converted to linear motion by a number of crosshead assemblies, each of which are connected, either directly or through connecting "pony" rods, to a corresponding plunger.

The major component of the fluid end is the pump housing or block. In frac pumps, the fluid end block is typically a single, unitary component, and it defines the pump cavity for each pumping unit in the pump. That is, the cylinders in which the plungers travel, the ports in which the valves are mounted, any access bores, and the pump chambers for all pump units are defined by the fluid end block.

The forces generated within, and the conditions under which modern frac pumps operate can fairly be described as extreme. Frac pumps typically generate at least 1,800, and up to 3,000 or more horsepower. They operate at fluid pressures up to 18,000 pounds per square inch (psi) or more. Each piston is cycling at 2 to 3 times a second, thus creating a variety of cyclic, extremely high forces generated from both the power end driving the plungers and from the fluid passing through the block. Those forces cycle through the block and the rest of the pump along numerous vectors. Such forces, over time, induce cracking, both visible and microscopic, that can lead to failure. Cracking also can be exacerbated by the chemical action of fluids being pumped through the block. Moreover, the fluid passing through the pump is highly abrasive and often corrosive. The fluid end and other internal components of the pump may suffer relatively rapid material loss.

Frac jobs also can be quite extensive, both in terms of the pressures required to fracture a formation and the time required to complete all stages of an operation. Prior to horizontal drilling, a typical vertical well might require fracturing in only one, two or three zones at pressures usually well below 10,000 psi. Fracturing a horizontal well, however, may require fracturing in 20 or more zones. Horizontal wells in shale formations such as the Eagle Ford shale in South Texas typically require fracturing pressures of at least 9,000 psi and 6 to 8 hours or more of pumping. Horizontal wells in the Haynesville shale in northeast Texas and northwest Louisiana require pressures around 13,500 psi. Horizontal wells in the Permian basin may be fractured in up to 80 or 100 stages at pressures approaching 10,000 psi. Pumping may continue near continuously—at flow rates of 2 to 3 thousand gallons per minute (gpm)—for several days before fracturing is complete.

Any failure of the pumps or other system components on site may interrupt fracturing, potentially reducing its effectiveness and inevitably increasing the amount of time required to complete the operation. Moreover, if a component such as a pump fails catastrophically, large quantities of fluid can be ejected at very high pressures, potentially injuring workers. Pumps and their various components must be certified and periodically inspected and recertified, but not all damage to or weakening of the components may be detected. Fatigue stress and microscopic fracturing is difficult to detect and can lead to catastrophic failure.

The statements in this section are intended to provide background information related to the invention disclosed and claimed herein. Such information may or may not constitute prior art. It will be appreciated from the foregoing, however, that there remains a need for new and improved high pressure pumps and methods for protecting high pressure pumps from excessive wear and tear. Such disadvantages and others inherent in the prior art are addressed by various aspects and embodiments of the subject invention.

SUMMARY OF THE INVENTION

The subject invention, in its various aspects and embodiments, relates generally to high pressure, high volume reciprocating pumps, and especially to those used in the oil and gas industry to fracture a well. Broad embodiments of the invention are directed to improved fluid ends and fluid end blocks for such pumps. The fluid end block comprises a plunger cylinder having a primary axis, a suction bore having a primary axis, a discharge bore, and a pump chamber. The pump chamber is defined by the intersection of the plunger cylinder, the suction bore, and the discharge bore. It has a cylindrical portion extending along the primary axis of the suction bore. The cylindrical portion has a diameter greater than the diameter of the plunger cylinder. The pump chamber also has a ridge that extends radially inward from the walls of the pump chamber in a plane normal to the suction bore primary axis.

Other embodiments provide such fluid end blocks where the fluid end block further comprises an access bore intersecting with the pump chamber and wherein the ridge comprises a pair of semi-annular ridges extending between the intersections of the plunger cylinder and the access bore with the pump chamber.

Still other embodiments provide such fluid end blocks where the ridge is provided in the cylindrical portion of the pump chamber or where the ridge is in the lower portion of the cylindrical portion of the pump chamber.

Additional embodiments provide such fluid end blocks where the ridge has an external radius at its apex, an internal radius at its base, and flats extending between the apex and base radii. Other embodiments provide such fluid end blocks where the ridge is adapted to provide a stop for a suction valve retainer.

Yet other embodiments provide fluid ends for a reciprocating frac pump that comprise such fluid end blocks and reciprocating frac pumps comprising such fluid ends.

In other aspects and embodiments, the subject invention provides for suction valve retainers for a reciprocating frac pump. The suction valve retainer is adapted for installation with a pump chamber of the pump. The retainer comprises a center portion, a lug, and a pair of arms. The retainer center portion is adapted to engage a spring extending from a suction valve body of the pump. The lug extends downward from the center portion and is adapted to position the spring on the retainer center portion. A passage extends from the bottom of the lug upwards along a central axis of the retainer and is adapted to accommodate a valve stem. The arms extend radially away and upwards from opposite sides of the center portion. The arms having an arcuate bearing surface adapted to bear upwards on a ridge in the pump chamber when the spring is under compression.

Other embodiments provide such suction valve retainers where the arms are generally open inward of their periphery, where the retainer has an axial plane of symmetry extending through the arms, or where the passage is a through passage.

Still other embodiments provide a fluid end for a reciprocating frac pump. The fluid end comprises a fluid end block, a ridge in a pump chamber in the fluid end block, a suction valve body, the novel suction valve retainers, and a spring extending from the suction valve body to the suction valve retainer. The arms of the suction valve retainer bear upward on the ridge. The spring is positioned on the suction valve retainer by the lug.

Additional embodiments provide such fluid ends where the suction valve body has a stem and the valve stem extends into the lug passage.

Yet other embodiments provide reciprocating frac pumps comprising such fluid ends.

In still other aspects and embodiment, the subject invention provides discharge plugs for a reciprocating frac pump. The discharge plug comprises a body, a cylindrical post, and a passage. The plug is adapted for mounting in a discharge bore of a fluid end of the pump. The cylindrical post extends downward from the body and is adapted to engage a spring extending from a discharge valve body of the pump. The post has an area of reduced outer diameter at its terminus providing a lug. The lug is adapted to position the spring on the post. A passage extends from the bottom of the lug upwards along a central axis of the body. The passage is adapted to accommodate a valve stem.

Other embodiments provide such discharge plugs where the passage extends into the post and the post has a transverse port communicating with the passage.

Still other embodiments provide such discharge plugs where the discharge plug comprises an annular seal and where the annular seal extends around the periphery of the body.

Additional embodiments provide fluid ends for a reciprocating frac pump. The fluid end comprises a fluid end block defining a discharge bore, the novel discharge plugs installed in the discharge bore, a discharge valve body, and a spring extending from the discharge valve body to the discharge plug. The spring is positioned on the discharge plug by the lug.

Yet other embodiments provide such fluid ends where the discharge valve body has a stem and the stem extends into the lug passage.

Further embodiments provide reciprocating frac pumps comprising the novel fluid ends.

In other aspects and embodiments, the subject invention provides suction plugs for a reciprocating frac pump. The suction plug comprises a cylindrical body. The cylindrical body is adapted for mounting in an access bore of a fluid end of the pump. The body has a nominal diameter portion, a reduced diameter portion and an annular seal groove. The nominal diameter portion is proximate an external face of the plug. The reduced diameter portion extends from an inner face of the plug. The annular seal groove is adjacent the outer terminus of the reduced diameter portion. An elastomer annular seal is mounted in the seal groove.

Other embodiments provide such suction plugs where the body has an annular backup rabbet between the seal groove and the nominal diameter portion. A continuous backup ring is mounted in the backup rabbit.

Still other embodiments provide such suction plugs where the diameter of the bottom of the backup rabbet is substantially equal to or greater than the diameter of the reduced diameter portion of the body or where the diameter of the bottom of the backup rabbet is substantially equal to the diameter of the reduced diameter portion of the body.

Additional embodiments provide such suction plugs where the plug comprises first and second continuous backup rings mounted in the backup rabbet. Other embodiments provide such suction plugs where the first backup ring is positioned adjacent the elastomer seal and is composed of an engineering plastic and the second backup ring is positioned adjacent the first backup ring and is composed of metal.

Yet other embodiments provide fluid ends for a reciprocating frac pump. The fluid end comprises the novel suction plugs. Other embodiments provide for reciprocating frac pumps. The frac pumps comprise the novel fluid ends.

Finally, still other aspects and embodiments of the invention provide pumps which have various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1:
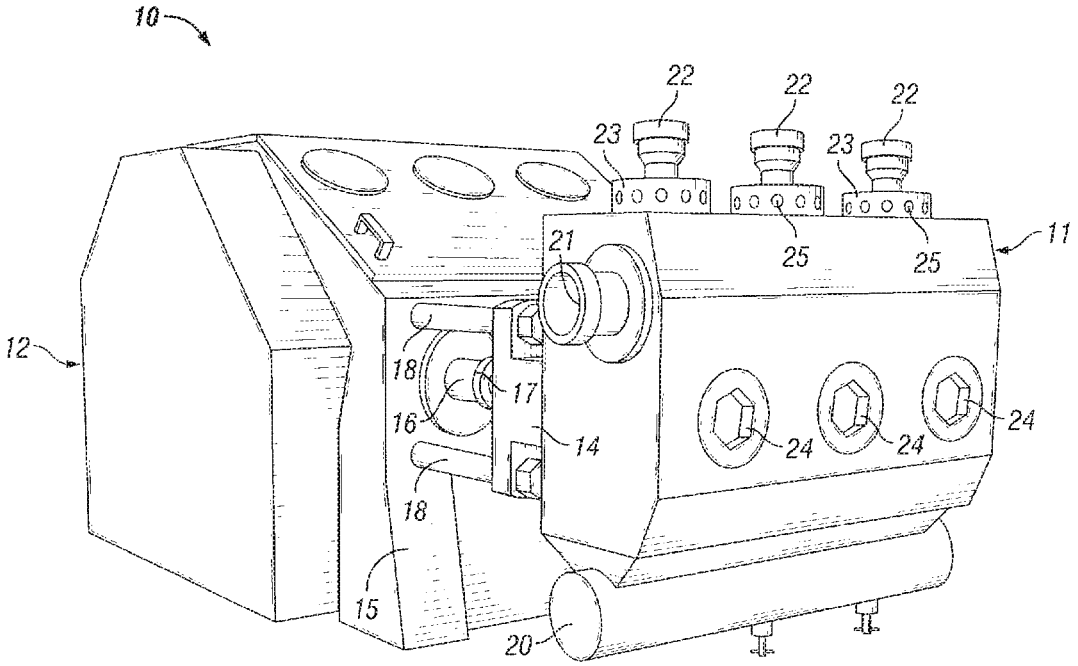
FIG. 1 (PRIOR ART)
FIG. 1 (prior art) is an isometric view of a prior art frac pump 10 which is generally representative of prior art frac pumps in which the novel improvements may be incorporated.
Figure 2:
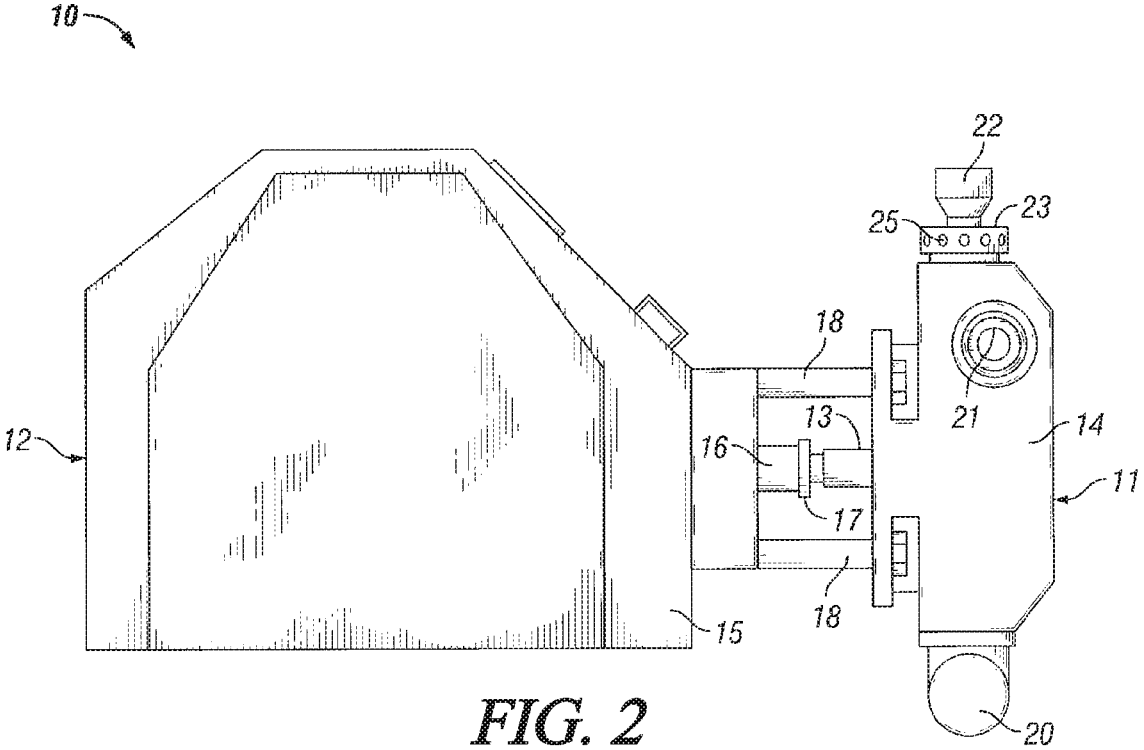
FIG. 2 (PRIOR ART)
FIG. 2 (prior art) is a side elevational view of prior art pump 10 shown in FIG. 1.
Figure 3:
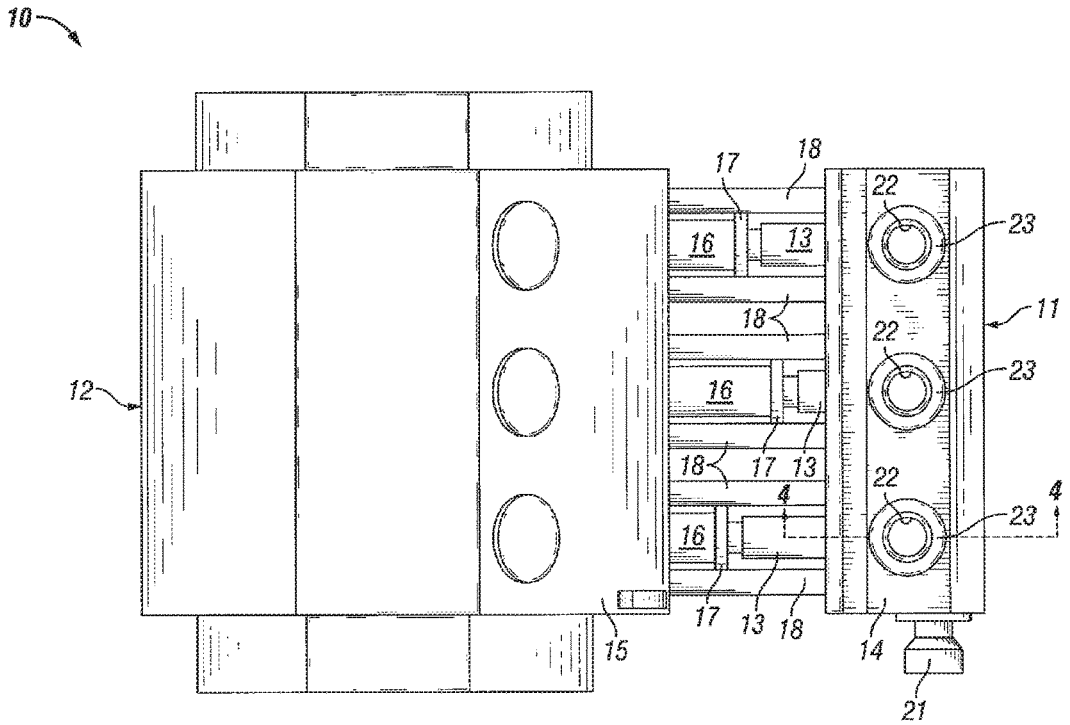
FIG. 3 (PRIOR ART)
FIG. 3 (prior art) is a top plan view of prior art pump 10 shown in FIGS. 1 and 2.

In the drawings and description that follows, like parts are identified by the same reference numerals. The drawing figures are not necessarily to scale. Certain features of the embodiments may be shown exaggerated in scale or in somewhat schematic form and some details of conventional design and construction may not be shown in the interest of clarity and conciseness.

DESCRIPTION OF ILLUSTRATIVE EMBODIMENTS

The subject invention, in various aspects and embodiments, is directed generally to high pressure, high volume reciprocating pumps, such as those used in fracturing oil and gas wells, and in particular to various aspects and features of the fluid end of such pumps. Specific embodiments will be described below. For the sake of conciseness, however, all features of an actual implementation may not be described or illustrated. In developing any actual implementation, as in any engineering or design project, numerous implementation-specific decisions must be made to achieve a developers' specific goals. Decisions usually will be made consistent within system-related and business-related constraints, and specific goals may vary from one implementation to another. Development efforts might be complex and time consuming and may involve many aspects of design, fabrication, and manufacture. Nevertheless, it should be appreciated that such development projects would be a routine effort for those of ordinary skill having the benefit of this disclosure.

The subject invention provides various improvements in the fluid end of frac pumps. Common and conventional designs for such frac pumps may be described by reference to FIGS. 1-5 which show a conventional frac pump 10. That description and the description of the novel fluid ends and components thereof that follow, will use relative terms such as "upper," "lower," "above," "below," and the like to describe relative positions of components or features. Those terms shall be understood in the context of the typical orientation of a frac pump while it is in service, that is, the views of FIGS. 1 and 6. It is believed that the novel improvements may be easily incorporated by workers of ordinary skill in the art into frac pump 10 and other conventional pump designs through routine effort.

Figure 4:
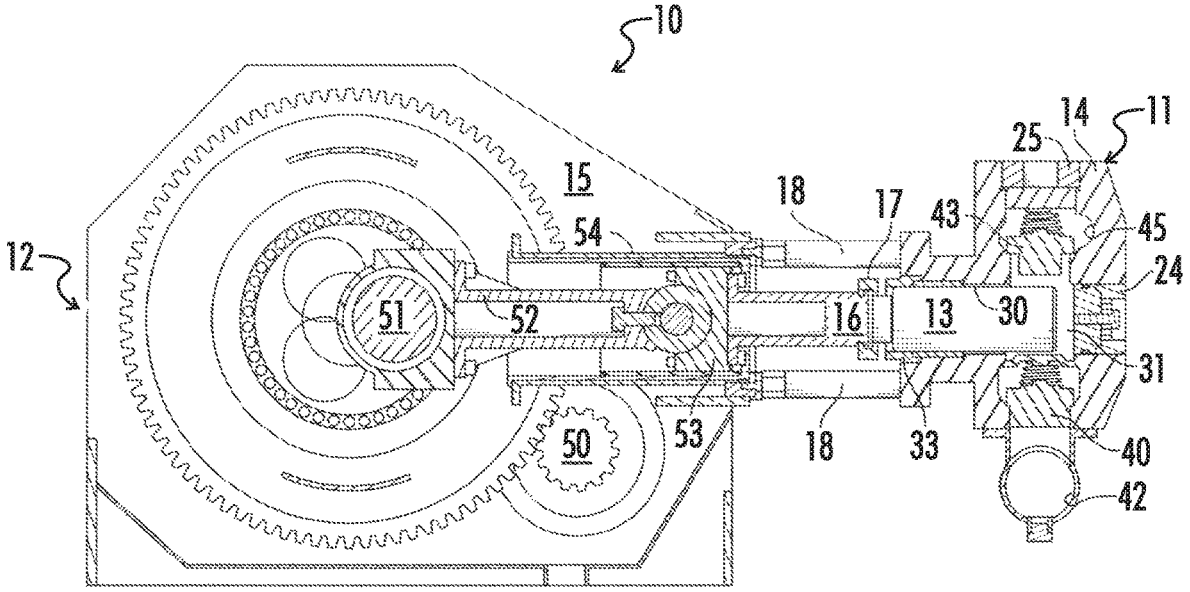
FIG. 4 (PRIOR ART)
FIG. 4 (prior art) is a transverse cross-sectional view, taken generally along line 4-4 of FIG. 3, of prior art pump 10 shown in FIGS. 1-3.
Figure 5:
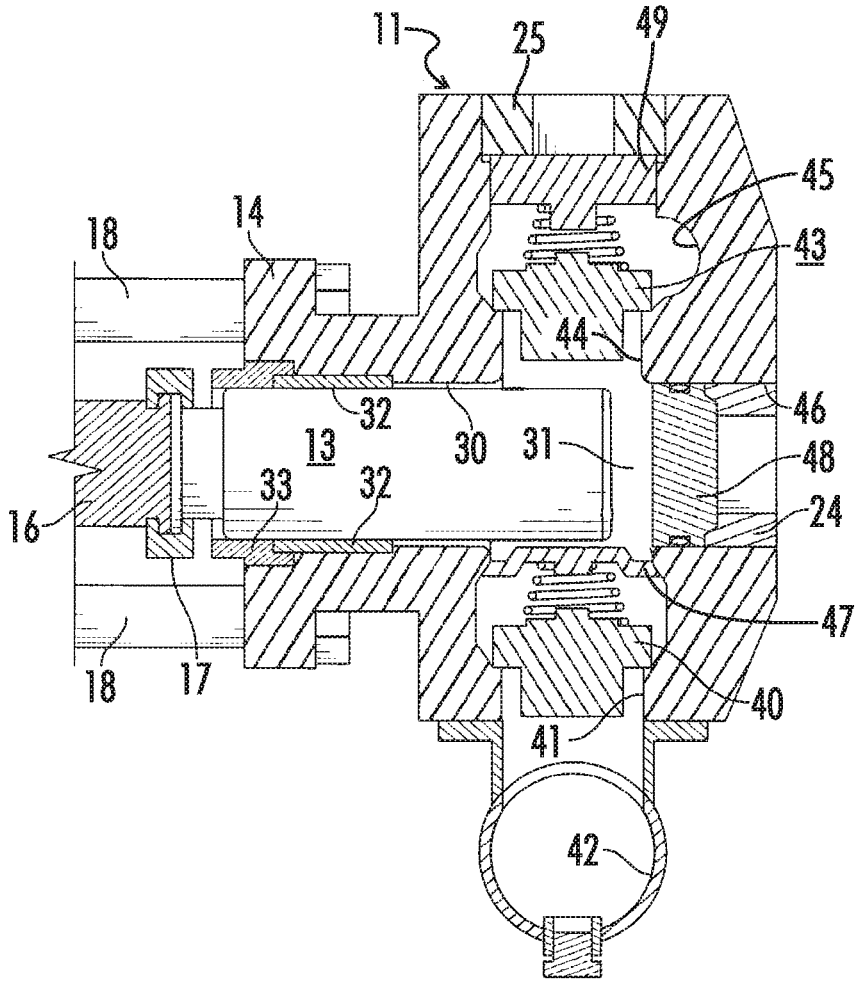
FIG. 5 (PRIOR ART)
FIG. 5 (prior art) is an enlarged view of the fluid end 11 of pump 10 shown in cross-section in FIG. 4.

Frac pump 10 is a triplex pump. It has three synchronized, manifolded reciprocating pumping units mounted in its so-called "fluid end" 11. The pumping units in fluid end 11 are all powered by a common so-called "power end" 12. The pumping units have essentially the same construction, one of which is shown in FIGS. 4-5. As shown therein, each pumping unit includes a reciprocating plunger 13 which is mounted in a cylinder 30. Cylinders 30 for all three plungers 13 are defined in a common housing or fluid end block 14 shown generally in FIGS. 1-5. Fluid end block 14, as is typical, is cast and milled from high strength steel as a single component. It is the major portion of fluid end 11 of pump 10. It not only defines cylinders 30 in which plungers 13 reciprocate, but also the other chambers and bores, and provides a base to which the other fluid end components are mounted directly or indirectly.

Power is supplied to plungers 13 via power end 12 of pump 10. Power end 12 is rigidly and securely connected to fluid end 11 via a plurality of stay rods 18 which extend between a power end housing 15 and fluid end block 14. Various covers (not shown) are provided in power end housing 15 to allow access to its inner components. It will be appreciated that power end 12 does not actually generate power. Instead, power is transmitted to power end 12 by an engine or motor, such a diesel engine (not shown).

Power from the engine's rotating drive shaft drives a gear mechanism 50 mounted in power end housing 15 as seen in FIG. 4. Gear mechanism 50 is operably connected to a crankshaft 51. Crankshaft 51 actuates separate drive mechanisms for each plunger 13. For example, a connecting rod 52 extends from crankshaft 51 to crosshead assembly 53. Crosshead assembly 53 is slidably mounted on a guide 54 which is mounted within power end housing 15. Thus, rotation of crankshaft 51 is converted to linear motion by crosshead assembly 53 and connecting rod 52. That is, crosshead assembly 53 will reciprocate linearly, i.e., slide back and forth in crosshead guide 54 as crankshaft 51 is rotated.

The crosshead assembly is operably connected, either directly or indirectly, to the plungers. For example, crosshead assembly 53 is connected to plunger 13 via pony rod 16, which in turn is connected to plunger 13 via connector 17. The reciprocating, linear motion of crosshead assembly 53, thus, is transmitted to plunger 13. It will be appreciated that the crosshead assemblies and other internal mechanisms in the power end of the other two pump units of pump 10 are substantially identical to the unit described above.

Fluid enters fluid end 11 of pump 10 through one of two inlets 20 (the other inlet 20 being capped during operation) and is pumped out through one of two outlets 21 (the other outlet 21 being capped). Access to internal components of fluid end 11 is provided via bores having threaded covers, such as suction covers 24 and discharge covers 25 shown in FIGS. 4-5. One or more discharge covers 25 may be replaced by stems, such as stems 22 shown in FIGS. 1-3, which are mounted on fluid end block 14 by threaded nuts 23. Stems 22 provide communication with fluid flowing out of pump outlet 21, and pressure or flow gages and the like (not shown) may be threaded into stems 22 to monitor pump operating conditions.

Each plunger 13, as may be seen in in FIGS. 4-5, reciprocates in a cylinder 30 defined in fluid end block 14. Plunger 13 is connected at its rear (left) end to pony rod 16 by connector 17. It should be noted that plunger 13 shown in FIGS. 4-5 is near the full extent of its pump stroke, at which point its forward (right) end extends well into a pump chamber 31. A packing 32 is loaded into a slightly enlarged, rear portion of cylinder 30 to provide a fluid tight seal between cylinder 30 and reciprocating plunger 13. Given that fluid flowing through pump 10 typically contains an abrasive proppant, packing 32 must be replaced frequently. Packing 32 is held in place, therefore, by a threaded, annular nut 33, commonly referred to as a gland nut, which screws into fluid end block 14.

Packing 32 typically incorporates a number of elastomeric, metallic, and/or composite components. Various lubrication channels usually are provided in packing 32, packing nut 33, and/or fluid end block 14 as well. Such features, however, are well known in the art and are not material to illustrating the subject invention and, therefore, are not shown in detail in FIGS. 4-5. Suffice it to say that packing 32 is subject to extreme wear and must be replaced periodically by, biter alia, removing packing nut 33.

Packing nut 33 is of conventional design. The body of packing nut 33 is generally cylindrical, its central aperture allowing plunger 13 to pass therethrough. Its inner end has threads on its outer circumference so that packing nut 33 may be threaded into fluid end block 14. The other, outer end of packing nut 33 is unthreaded, has a generally smooth exterior surface, and extends somewhat beyond the adjacent surface of fluid end block 14.

Referring again to FIGS. 4-5, pump chamber 31 has a spring-loaded, one-way suction valve 40 mounted in an enlarged portion of a suction bore 41. Suction bore 41 is in fluid communication with fluid inlet 20 of pump 10 via a manifolding chamber 42 (as are the suction bores 41 of the other pumping units). A spring is mounted on top of suction valve 40 and extends upward into engagement with a suction valve retainer 47. Retainer 47 has ends that conform to and are adapted to bear on the walls of suction bore 41 below pump chamber 31. It may be inserted at an angle through pump chamber 31 and into suction bore 41. Retainer 47 will be used to over-compress the spring and then will be placed in its proper position. Compression on the spring will be released somewhat so that the ends of retainer 47 bear on the walls of suction bore 41. Retainer 47 and suction valve 40 thus are both held in place by the compression spring.

A spring-loaded, one-way discharge valve 43 is mounted in an enlarged portion of a discharge bore 44. Discharge bore 44 is in fluid communication with fluid outlet 21 of pump 10 via another manifolding chamber 45 (as are the discharge bores 44 of the other pumping units). A spring is mounted on top of discharge valve 43 and extends upward into engagement with a discharge plug 49. Discharge plug 49 is installed in the upper portion of discharge bore 44 and prevents fluid from leaking out of pump chamber 31 through discharge bore 44. Discharge plug 49 is held in place by threading a cover 25 into the top, otherwise open end of discharge bore 44. Once installed, it will place the spring under slight compression to bias discharge valve 43 in its downward, shut position.

Thus, suction valve 40 will open, and fluid will be drawn into pump chamber 31 via pump inlet 20, manifolding chamber 42, and suction bore 41 as plunger 13 withdraws from pump chamber 31. Discharge valve 43 then will open, and fluid will be pumped out of chamber 31 into discharge bore 44, and thence into manifolding chamber 45 and pump outlet 21, as plunger 13 enters chamber 31.

Given that fluid flowing through pump 10 often contains an abrasive proppant, valves 40 and 43 necessarily wear out and must be replaced frequently. Fluid end block 14, therefore, has an access bore 46 associated with each pump chamber 31 that allows access to suction valve 40. Discharge bore 44 allows access to discharge valve 43. A cylindrical plug (commonly referred to as a "suction plug") 48 is mounted in the inner portion of access bore 46. Suction plug 48 is secured in place by threaded cover 24, commonly referred to as a "suction" cover. Suction plug 48 prevents fluid from leaking out of pump chamber 31 through access bore 46. Thus, valves 40 and 43 in pump chamber 31 may be replaced as needed by, infer alia, removing threaded suction covers 24 and discharge covers 25.

Figure 6:
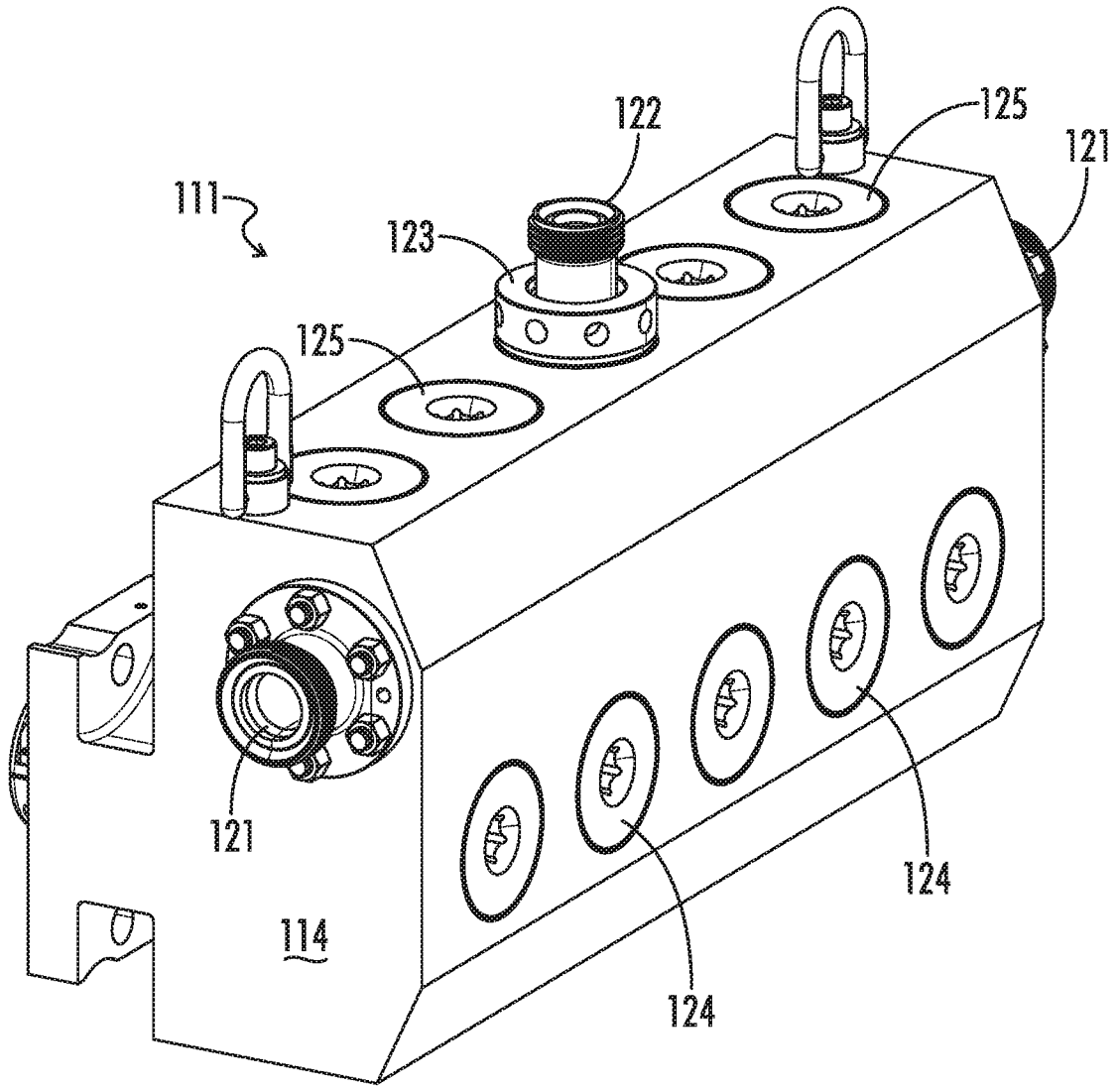
FIG. 6 is an isometric view of a first preferred embodiment 111 of the frac pump fluid ends of the subject invention.
Figure 7:
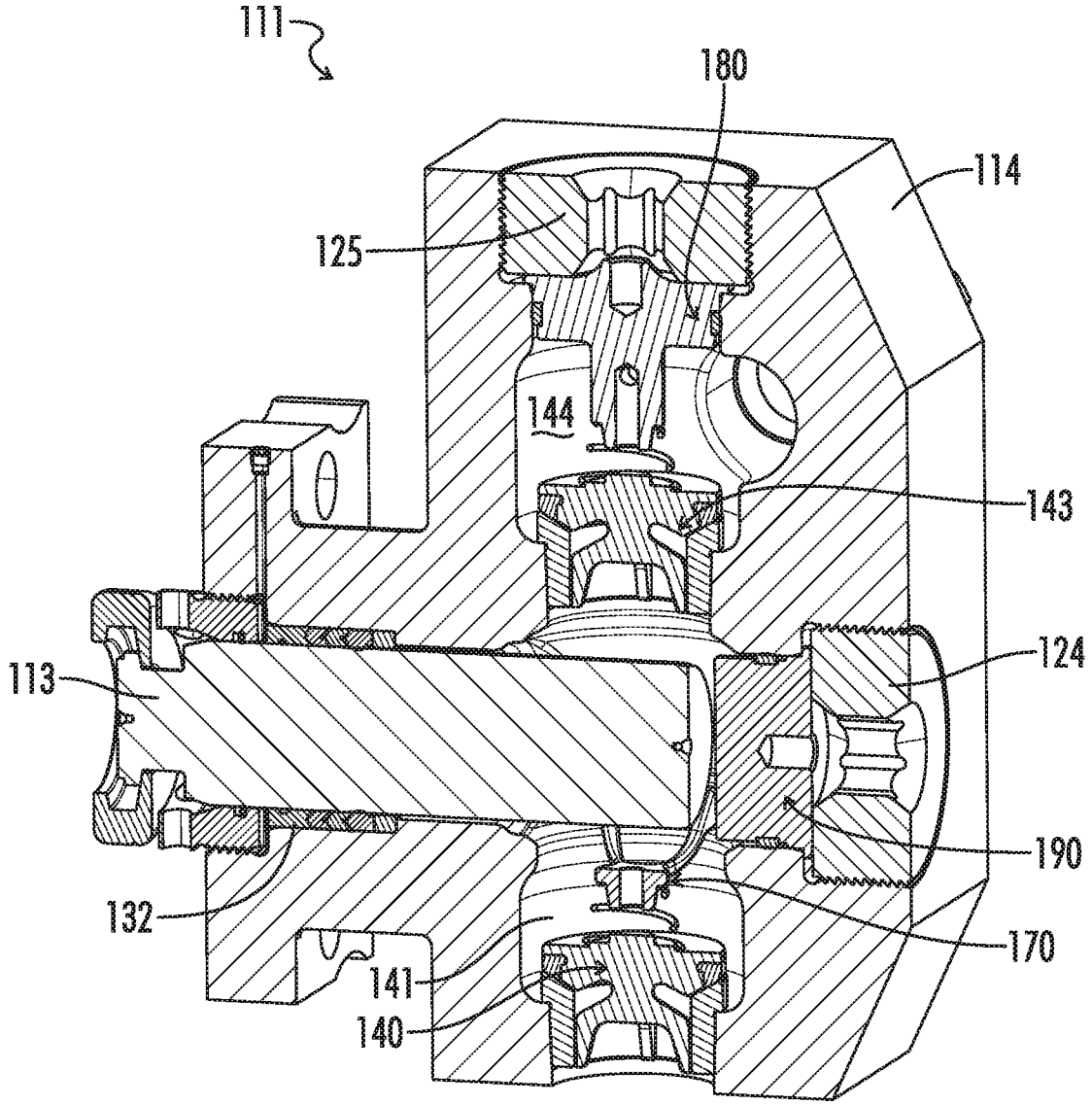
FIG. 7 is an isometric, transverse cross-sectional view of novel fluid end 111 shown in FIG. 6, which fluid end 111 incorporates a preferred embodiment 114 of the fluid end blocks of the subject invention, a preferred embodiment 170 of the suction valve retainers of the subject invention, a preferred embodiment 180 of the discharge plugs of the subject invention, and a preferred embodiment 190 of the suction plugs of the subject invention.
Figure 8:
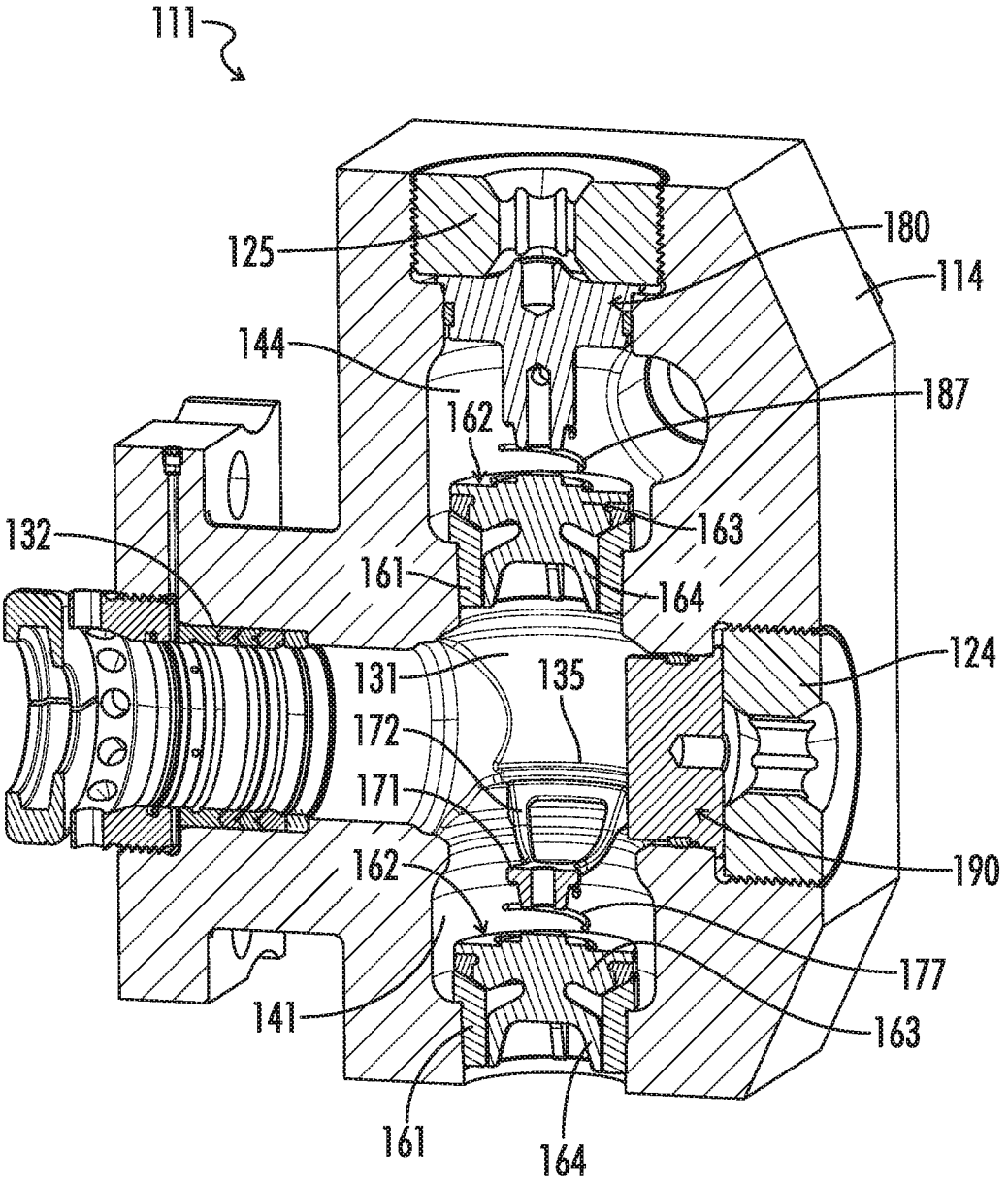
FIG. 8 is the same view of novel fluid end 111 as in FIG. 7, except that plunger 113 has been removed to more clearly show the other components of fluid end 111.
Figure 9:
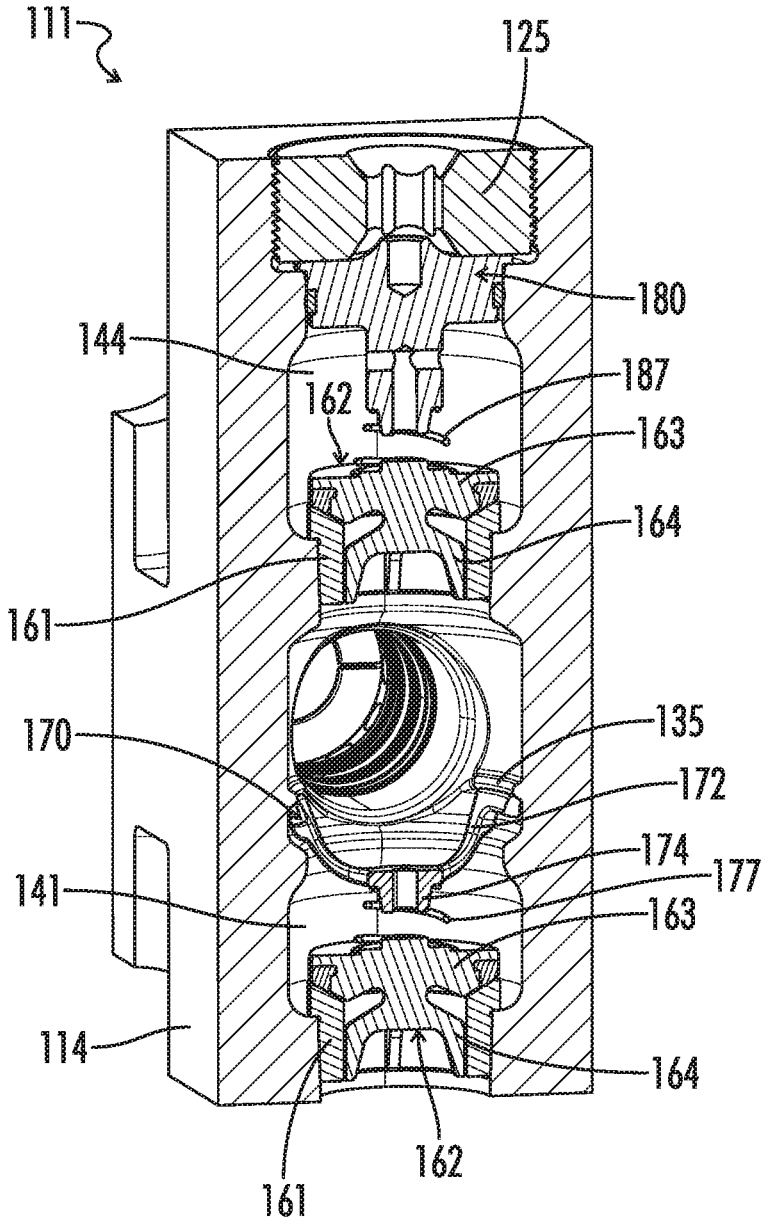
FIG. 9 is an isometric, lateral cross-sectional view of a portion of novel fluid end 111, which portion shows a single pumping unit, and wherein plunger 113 has been removed to more clearly show the other components of fluid end 111.
Figure 10:
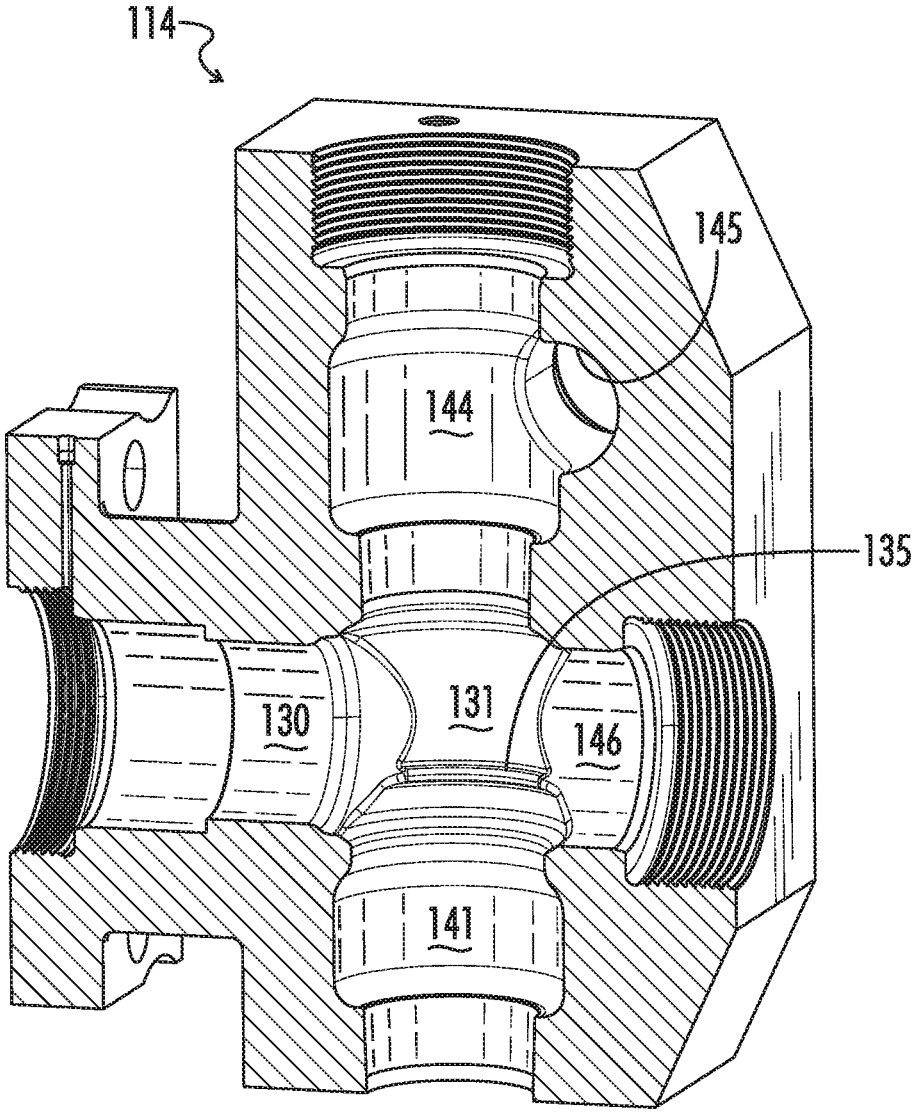
FIG. 10 is the same view of novel fluid end 111 as in FIGS. 7-8, except that all components have been removed to more clearly show the features of novel fluid end block 114.

Various improvements to such conventional pump designs and, in particular, to the fluid ends of such pumps may be exemplified by first referring to FIG. 6. FIG. 6 shows a first preferred embodiment 111 of the frac pump fluid ends of the subject invention. Fluid end 111 is adapted for a "quintiplex" pump having five essentially identical pumping units. It shares many common design features with fluid end 11 of conventional triplex pump 10. A fluid end block 114 defines the various chambers and bores in the pump and a base to which the other fluid end components are mounted directly or indirectly. Access to internal components of fluid end 111 is provided via bores having threaded covers, such as suction covers 124 and discharge covers 125. One or more discharge covers 125 may be replaced by stems, such as stem 122, which is mounted on fluid end block 114 by threaded nut 123. Fluid end 111 will be connected to a conventional power end, such as power end 12. Likewise, a suction manifold, such as manifolding chamber 42, will be assembled to fluid end 111 to allow fluid to be drawn into fluid end 111. Fluid will be pumped out of fluid end 111 through a pair of inlets 120.

The pumping units in fluid end 111 also operate in a fashion similar to conventional fluid end 11. As discussed in detail below, however, fluid end 111 incorporates a preferred embodiment 114 of the fluid end blocks of the subject invention, a preferred embodiment of the suction valve retainers of the subject invention, a preferred embodiment 180 of the discharge plugs of the subject invention, and a preferred embodiment 190 of the suction plugs of the subject invention.

The pumping units in fluid end 111 are essentially identical, one of which is shown in FIGS. 7-13. As may be seen in FIG. 7, each pumping unit includes, from an operational standpoint, a reciprocating plunger 113, a suction valve 140, and a discharge valve 143. The other components of the pumping units are seen best in FIGS. 8-9, which show a pumping unit of fluid end 111 with plunger 113 removed. The various chambers and bores in fluid end block 114 may be seen best in FIGS. 10-13, which show fluid end 111 with all internal components removed. As may be seen best therein, each pumping unit in fluid end 111 has a cylinder 130, a suction bore 141, a discharge bore 144, and an access bore 146 defined in fluid end block 114. Cylinder 130 and access bore share a common primary axis, while suction bore 141 and discharge bore 144 share a common primary axis. Cylinder 130 and bores 141/144/146 intersect to define a pump chamber 131.

Each plunger 113 reciprocates in its respective cylinder 130. A packing 132 is loaded into a slightly enlarged, rear portion of cylinder 130 to provide a fluid tight seal between cylinder 130 and reciprocating plunger 113. Plunger 113 is connected at its rear (left) end to a power end, for example, via a pony rod and connector as in conventional pump 10. Plunger 113 reciprocates into and out of pump chamber 131.

Suction valve 140 is mounted in suction bore 141. Suction bore 141 is provided with an area of enlarged diameter to accommodate suction valve 140. A throat is provided in the upper portion of suction bore 141 which transitions into pump chamber 131. Suction bore 141, as are the suction bores 141 of the other pumping units, is in fluid communication with a fluid inlet, for example, via a manifolding chamber such as manifolding chamber 42 of conventional pump 10 which receives flow through inlet 20.

Suction valve 140 is spring-loaded to provide one-way flow into pump chamber 131. More specifically, a spring 177 is mounted and extends—under load—between the top of suction valve 140 and suction valve retainer 170. Thus, suction valve 140 allows fluid to be drawn into pump chamber 131, but prevents it from being pumped out of pump chamber 131 as plunger 113 moves into and out of pump chamber 131.

Suction valve 140 is a conventional valve of the type disclosed in U.S. Pat. No. 9,435,454 to G. Blume. It generally comprises a seat 161 and a valve body 162. Valve body 162 will move up and down within seat 161 to allow valve 140 to open and close.

Seat 161 has a generally annular configuration with an axial, cylindrical passage. It is mounted in suction bore 141, for example, by a friction fit. A seal, typically an elastomeric O-ring, will be provided between seat 161 and fluid end block 114. Seat 161 has a seat surface on its upper end which is generally chamfered at an angle of about 45°.

Valve body 162 has a generally disc shaped head 163 from which depend a plurality of legs 164. Legs 164 serve to guide valve body 162 within the passage of seat 161. Legs 164 are spaced and extend downward and radially outward from a central column that extends downward from head 163. Fluid thus can flow past legs 164 at the same time that legs 164 ensure that valve body 162 moves reliably up and down through seat 161. The central portion of head 163 is generally concave providing head 163 with an annular bottom surface. A flat valve surface is provided on a radially inward portion of the bottom of head 163. The valve surface extends at an angle complementary to the angle of the seat surface on seat 161, that is, at about 45°. A groove extends around the periphery of the bottom of head 163, radially outward of the valve surface. An elastomeric seal is carried therein.

Figure 14:
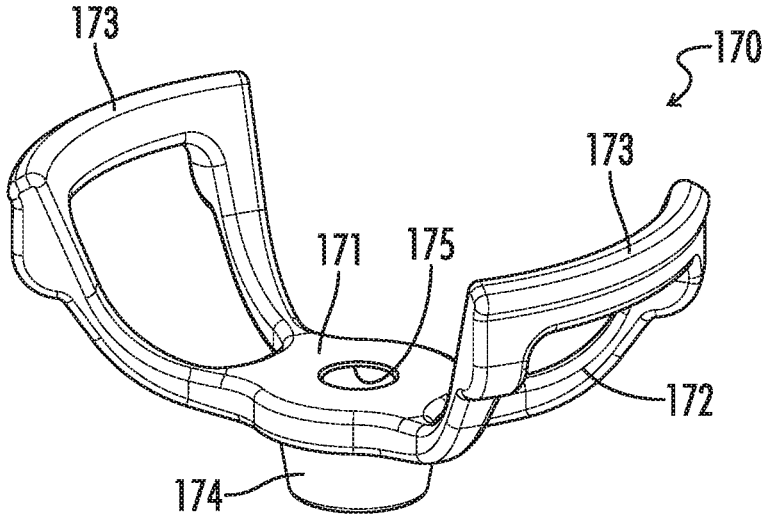
FIG. 14 is an isometric view, taken generally above and to one side of novel suction valve retainer 170.
Figure 15:
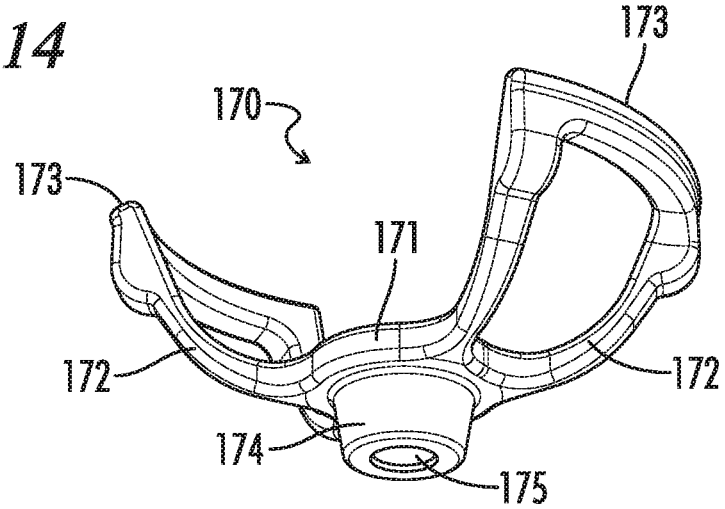
FIG. 15 is an isometric view, taken generally below and to one side of novel suction valve retainer 170 shown in FIG. 11.
Figure 16:
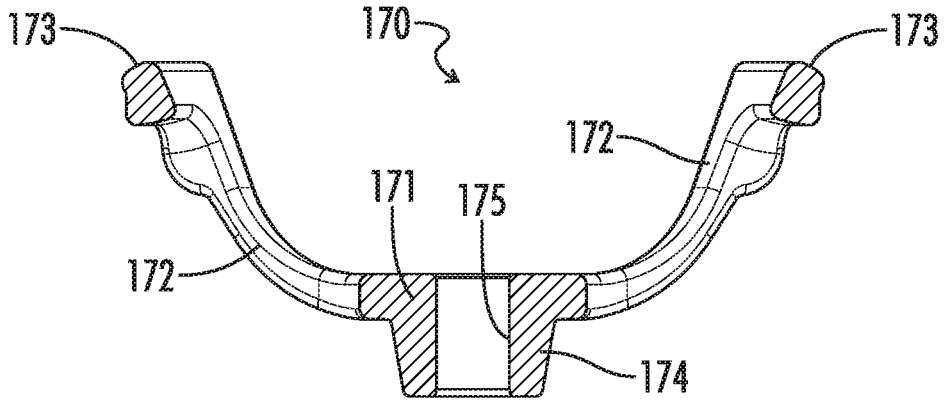
FIG. 16 is a cross-sectional view of novel suction valve retainer 170 shown in FIGS. 11-15.

Retainer 170, as seen best in FIGS. 14-16, has a center portion 171 which is designed to engage spring 177 extending upward from valve body 162. A lug 174 extends downward from the bottom of center portion 171. Lug 174 is a short, downwardly tapered cylindrical extension having an axial passage 175. Lug 174 will position and hold the upper end of spring 177 on center portion 171.

A pair of arms 172 extend radially away and upwards from opposite sides of center portion 171, preferably such that retainer 170 has a plane of symmetry extending through arms 172 and along the vertical, primary axis of retainer 170. Arms 172 terminate in a bearing surface 173 and preferably are generally open inward of their periphery. That is, arms 172 have cut-outs extending inward from their lateral edges leading from center portion 171 and bearing surface 173. The cut-outs allow fluid to flow more easily around retainer 171. Bearing surfaces 173 extend in an arc about the primary axis passing vertically through the center of retainer 170.

Figure 11:
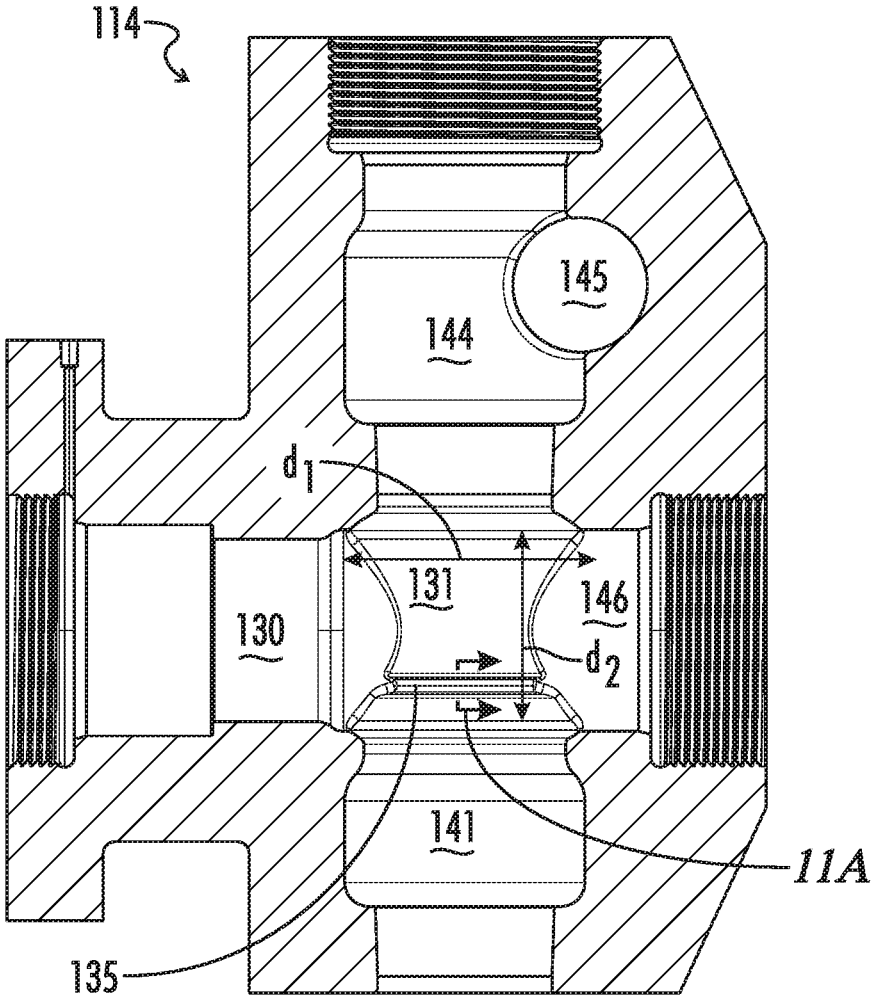
FIG. 11 is a transverse cross-sectional view of novel fluid end block 114.

When installed, bearing surfaces 173 of retainer 170 will bear on a pair of ridges 135 in pump chamber 131. As noted previously, and as seen best in FIGS. 10-13, pump chamber 131 is defined by the intersection of cylinder 130, suction bore 141, discharge bore 144, and access bore 146. It may be viewed, therefore, as having a general shape of two cylinders overlapping at right angles: a first cylinder having a diameter $d_1$ extending along the common axis of suction bore 141 and discharge bore 144, as shown in FIG. 11; and a second cylinder having a diameter $d_2$ extending along the common axis of cylinder 130 and access bore 146. The length of the first cylinder is equal to diameter $d_2$ of the second cylinder, and vice versa. As best appreciated from FIG. 11, diameter $d_1$ of the first cylinder is greater than the diameter of cylinder 130.

Ridges 135 are provided in the lower portion of the first cylinder portion of pump chamber 131, somewhat above suction bore 141. They extend radially inward from the walls of the first cylinder portion of pump chamber 131 in a plane normal to the primary axis of suction bore 141. They extend arcuately in that plane between the intersections of plunger cylinder 131 and access bore 146 with pump chamber 131. The minimum distance between the apex of ridges 135 will be greater than the length of a chord extending across cylinder 131 in the plane of ridges 135. Thus sized, the first cylinder portion and ridges 135 will allow retainer 170 to extend into pump chamber 131 and accommodate the travel of plunger 130 as it reciprocates into and out of pump chamber 131.

Figure 11A:
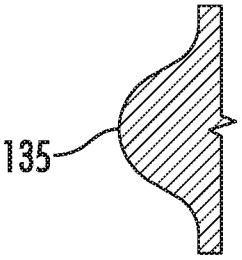
FIG. 11A is an enlarged, cross-sectional view of a ridge 135 in novel fluid end block 114.
Figure 12:
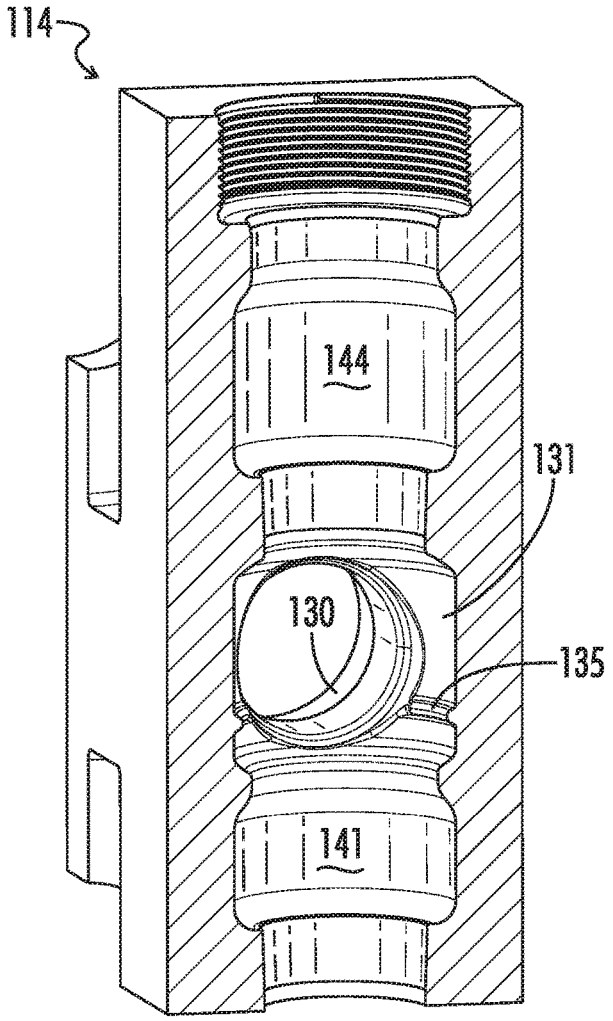
FIG. 12 is the same view of fluid end 111 as in FIG. 9, except that all components have been removed to more clearly show the features of novel fluid end block 114.
Figure 13:
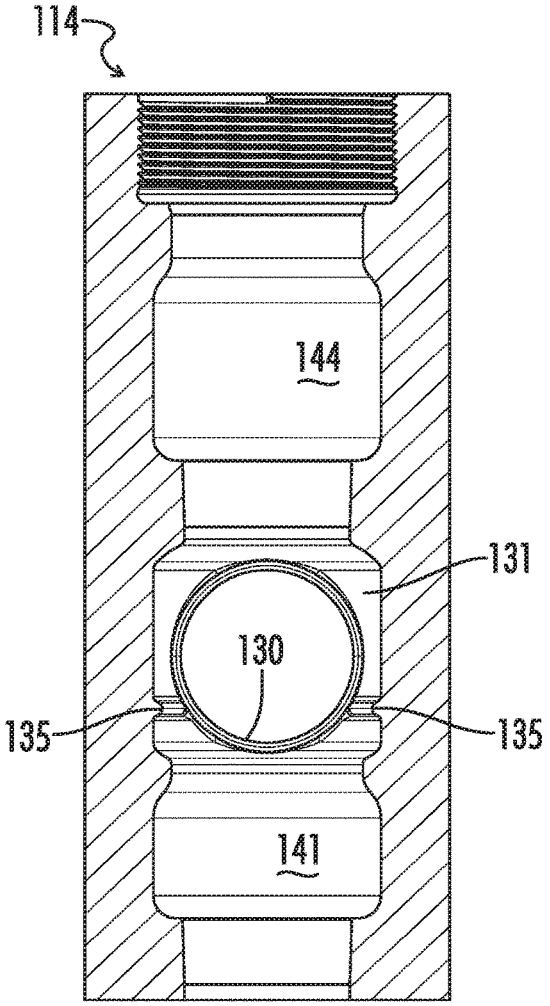
FIG. 13 is a lateral cross-sectional view of novel fluid end block 114.

When viewed in cross-section, as seen best in the enlarged view of FIG. 11A, ridges 135 have an external radius at their apex, and internal radius at their base, and flats extending between the apex and base radii. The lower profile of ridges 135 provide a bearing surface upon which retainer 170 will bear. Thus, the upper profile of bearing surfaces 173 of retainer 170 preferably conforms to the lower profile of ridges 135 to enhance the stability of retainer 170 during operation. Once installed, retainer 170 will place spring 177 under slight compression to bias suction valve 140 in its downward, shut position. Moreover, it is expected that retainer 270 will allow relatively free flow of fluid around it and will remain securely in place during operation of the pump.

It will be appreciated that ridges, such as ridges 135, in the pump chamber of the novel fluid end blocks can provide important benefits. As noted previously, the fluid end block of frac pumps is subjected to a variety of cyclic, extremely high forces generated from both the power end driving the plungers and from the fluid passing through the block. Those forces cycle through the block and the rest of the pump along numerous vectors. Such forces, over time, induce cracking, both visible and microscopic, that can lead to failure. While there are many other components in a frac pump that are susceptible to wear and failure, some of which must be replaced with regularity, cracking and wearing of the fluid end block of frac pumps is the costliest repair issue faced by pump owners, both in terms of actual repair costs and revenue lost while a pump is out of service. Often the entire block must be scrapped.

In particular, the pump chamber is an area of relatively high stress within fluid ends. Many conventional fluid ends, however, have grooves in the pump chamber. Those grooves can weaken the fluid end block, but are required for mounting suction valve retainers which, like novel suction valve retainer 170, have arms that extend upward into the pump chamber. Ridges, such as ridges 135 in novel fluid end block 114, however, reinforce fluid end block 114 and help distribute stress more effectively throughout fluid end block 114. Thus, ridges 135 offer an opportunity to extend the service life of fluid end block 114.

Discharge valve 143 is mounted in discharge bore 144. Discharge bore 144 is provided with an area of enlarged diameter to accommodate discharge valve 143. The enlarged diameter portion of discharge bore 144 transitions into pump chamber 131 below discharge valve 143. Discharge bore 144, as are the discharge bores 144 of the other pumping units, is in fluid communication with fluid outlet 121 of fluid end 111 via a manifolding chamber 145.

Discharge valve 143 is spring-loaded to provide one-way flow out of pump chamber 131. More specifically, a spring 187 is mounted and extends—under load—between the top of discharge valve 143 and discharge plug 180. Thus, discharge valve 143 allows fluid to be pumped out of pump chamber 131, but prevents it from being drawn back into pump chamber 131 as plunger 113 moves into and out of pump chamber 131. Other than its location in the discharge cavity, discharge valve 143 is identical to suction valve 140 described above.

Figure 17:
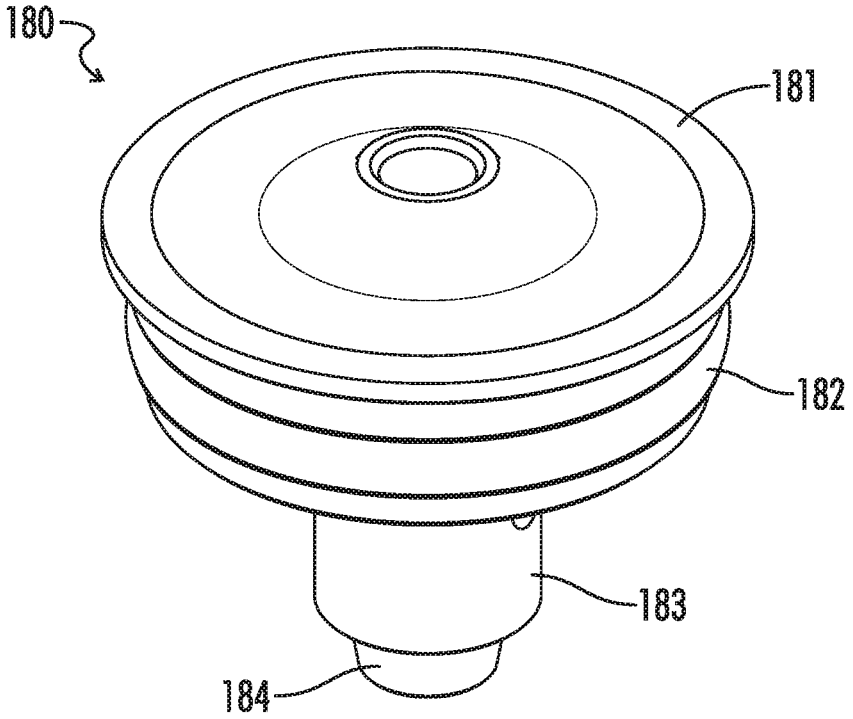
FIG. 17 is an isometric view, taken generally above and to one side of novel discharge plug 180.
Figure 18:
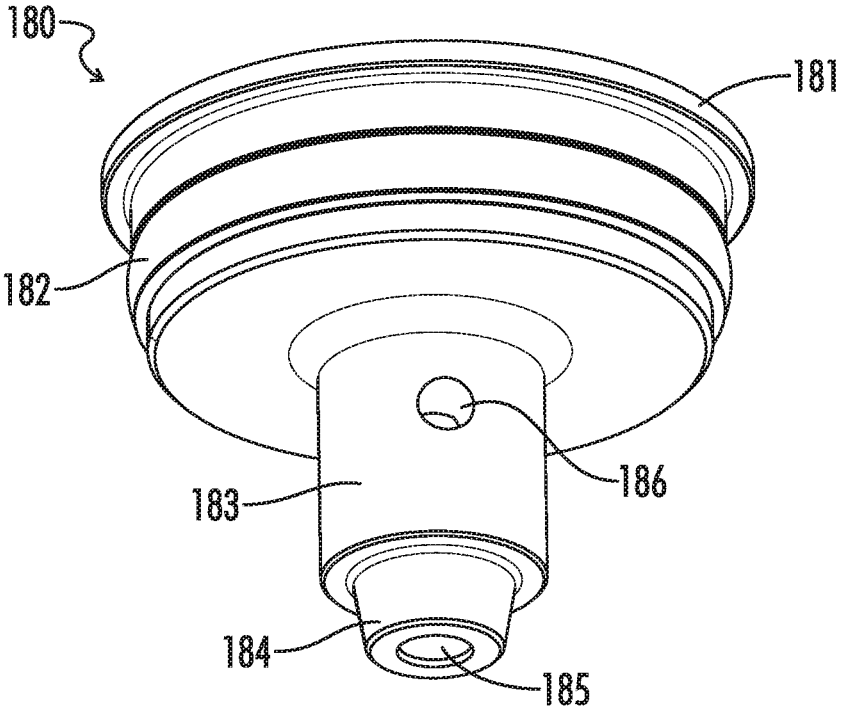
FIG. 18 is an isometric view, taken generally below and to one side of novel discharge plug 180 shown in FIG. 17.
Figure 19:
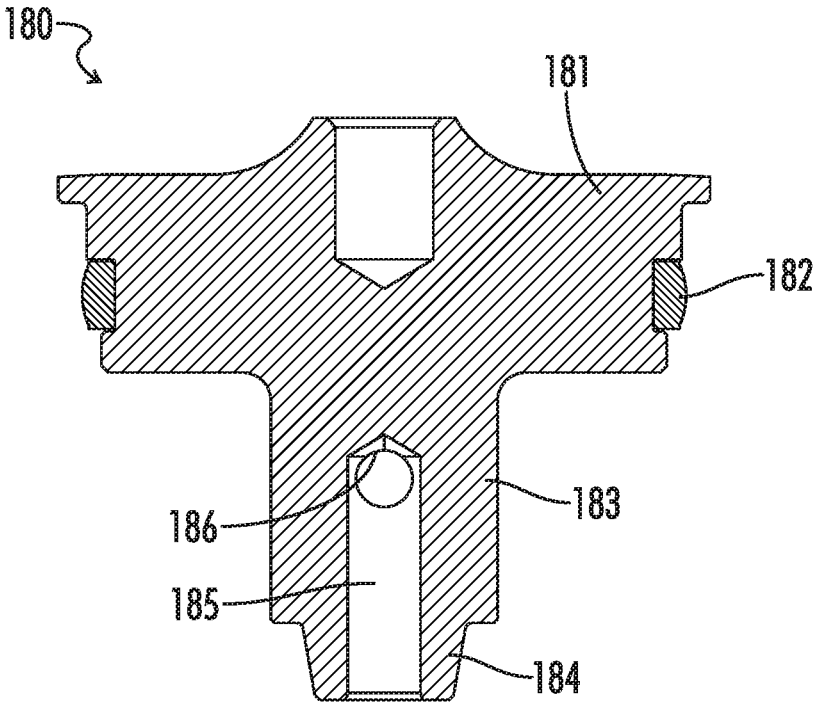
FIG. 19 is a cross-sectional view of novel discharge plug 180 shown in FIGS. 17-18.
Figure 20:
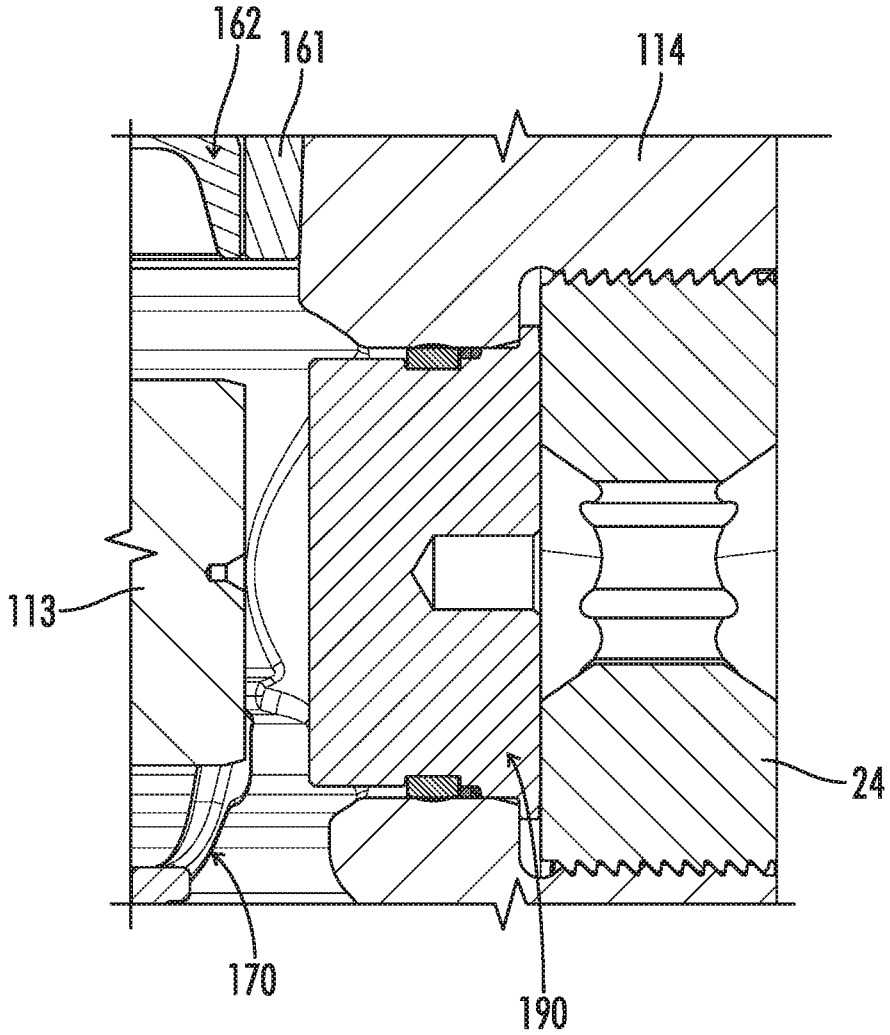
FIG. 20 is an enlarged view of a portion of novel fluid end block 114 showing novel suction plug 190 and suction cover 124.

Discharge plug 180 is installed in discharge bore 144 above discharge valve 143. As seen best in FIGS. 17-19, discharge plug 180 has a short, cylindrical body 181 that fits closely within an area of reduced diameter in discharge bore 144. An annular lip is provided at the top of body 181. The annular lip will shoulder out to ensure that plug 180 is properly positioned in discharge bore 144. An annular seal, such as O-ring 182 is mounted in an annular groove in the periphery of body 181 to prevent fluid from leaking out of pump chamber 131 through discharge bore 144. Discharge plug 180 is held in place by threading a cover 125 into the upper portion of discharge bore 144. Once installed, discharge plug 180 will place spring 187 under slight compression to bias discharge valve 143 in its downward, shut position.

More specifically, discharge plug 180 has a post 183 extending downward from the bottom of body 181 along the central axis of discharge plug 180. Post 183 is designed to engage spring 187 extending upward from valve body 162 of discharge valve 143. A lug 184 extends downward from the bottom of post 183. Lug 184 is a short, downwardly tapered cylindrical extension and will position and hold the upper end of spring 187 on post 183. A bottomed, axial passage 185 extends through lug 184 and into post 183. A transverse port 186 in post 183 communicates with passage 185.

Fluid end block 114 also is provided with an access bore 146 associated with each pump chamber 131 that allows access to suction valve 140. (Discharge bore 144 allows access to discharge valve 143.) Suction plug 190 is mounted in the inner portion of access bore 146. It is secured in place by threaded suction cover 124. Suction plug 190 prevents fluid from leaking out of pump chamber 131 through access bore 146.

Figure 21:
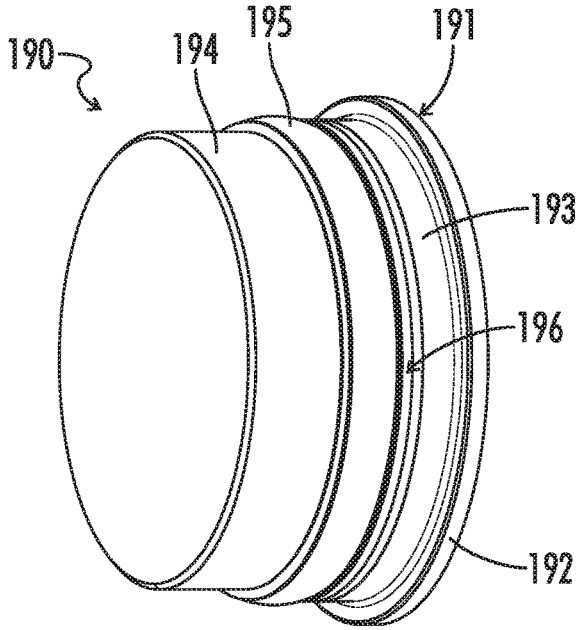
FIG. 21 is an isometric view, taken generally in front of and to the inside of novel suction plug 190.
Figure 22:
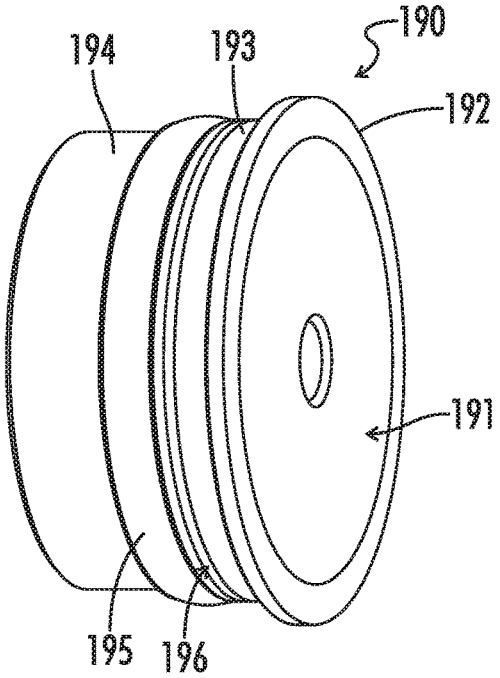
FIG. 22 is an isometric view, taken generally in front of and to the outside of novel suction plug 190 shown in FIG. 21.
Figure 23:
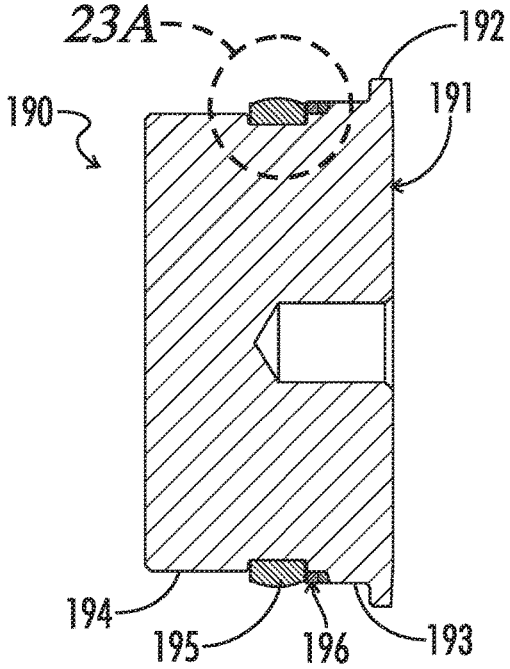
FIG. 23 is a cross-sectional view of novel suction plug 190 shown in FIGS. 21-22.
Figure 23A:
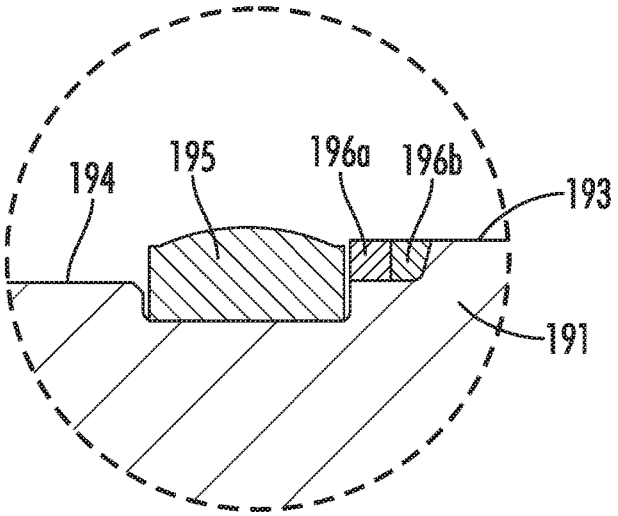
FIG. 23A is an enlarged view of area 23A shown in FIG. 23, showing details of sealing features of novel suction plug 190.

As best seen in FIGS. 21-23, suction plug 190 comprises a cylindrical body 191. An annular lip 192, or other projecting features, preferably is provided at the external face of cylindrical body 191 so that suction plug 190 shoulders out in access bore 146 in the proper position. Body 191 has a nominal diameter portion 193, extending proximate to the external face of suction plug 190, and a reduced diameter portion 194, which extends from the internal face of suction plug 190. Nominal diameter portion 193 of body 191 fits closely within a reduced diameter, inner portion of access bore 146. Reduced diameter portion 194 of body 191 creates an annular clearance between the inner ends of suction plug 190 and access bore 146.

An annular seal 195 is mounted in an annular groove extending around body 191 of plug 190. The groove is situated adjacent to the outer terminus of reduced diameter portion 194. Annular seal 195 is designed to prevent fluid from leaking out of pump chamber through access bore 146. Annular seal 195 preferably is an elastomer seal, such as an elastomer D-ring seal. Other conventional elastomer seals, however, are known and may be suitable for use in fluid end 111, such as O-rings, square cut rings, or lobed rings. Typically, seal 195 will be fabricated from elastomers such as nitrile butadiene rubber (NBR), hydrogenated nitrile butadiene nitrile rubber (HNBR), fluoroelastomers such as Viton® and Dyneon™, and tetrafluoroethylene propylene rubbers, such as Aflas™, polyurethane, and fluorosilicone. The choice of materials will be driven by conventional considerations, most commonly the nature of the fluids, the temperatures, and the pressures to which the seals will be exposed. For example, fluoroelastomers may be preferred for oily and corrosive fluids, and harder nitrile and polyester rubbers may be preferred for higher pressure seals.

Suction plug 190 also is preferably provided with at least one backup ring to reduce the likelihood that elastomer seal 195 will be extruded during operation of the pump. For example, suction plug 190 is provided with an annular rabbet at the inner terminus of the nominal diameter portion 193, that is, between the groove in which seal 195 is mounted and nominal diameter portion 193. A first backup ring **196*a* and a second backup ring 196*b*** are mounted in the rabbet.

One or both of backup rings 196 preferably are continuous rings. Thus, the diameter of the bottom of the rabbet is at least substantially equal to the diameter of reduced diameter portion 194 so that backup rings 196 may be sized to slip over reduced diameter portion 194 and to fit snugly in the rabbet. Preferably, the diameter of the rabbet will be slightly larger than the reduced diameter portion 194 so that backup rings 196 may be slipped more easily over reduced diameter portion 194 yet still fit snugly within the rabbet.

Backup rings 196 in general may be selected from many known conventional backup rings. They typically are made of fairly hard materials, such as metals or engineering plastics. For example, first backup ring **196*a* is adjacent elastomer seal 195. It preferably is fabricated from an engineering plastic having better thermal and mechanical properties than more commonly used plastics. Engineering plastics that may be suitable for use include polycarbonates and Nylon 6, Nylon 66, and other polyamides, including fiber reinforced polyamides such as Reny polyamide. "Super" engineering plastics, such as virgin and carbon-filled polyether ether ketone (PEEK) and polyetherimides such as Ultem®, are especially preferred. Mixtures and copolymers of such plastics also may be suitable. Second backup ring 196*b* is mounted behind first backup ring 196*a***. It preferably is fabricated from metal, such as bronzed aluminum or steel, brass, or bronze alloys.

It will be appreciated that the novel suction plugs, such as suction plug 190, provide significant advantages over suction plugs used in conventional frac pump fluid ends. While all conventional suction plugs incorporate an elastomer seal and many have backup rings to minimize extrusion of the elastomer seal, such backup rings are split rings. It is difficult, however, to manufacture and size split rings so that they provide even, continuous support for the elastomer seal over their service life. The ends may leave a gap when the ring is installed, or that may overlap. Even if the fit is quite good initially, they may be damaged during installation and service.

In contrast, reduced diameter portion 194 and the backup rabbet of novel suction plug 190 are sized to allow a continuous ring, such as backup rings 196, to be utilized. Backup rings 196 may be slipped over reduced diameter portion 194 and installed in the backup rabbet. Thus, they can consistently provide even, continuous support for elastomer seal 195.

It also will be appreciated that with conventional suction plugs, as in novel plug 190, the elastomer seal typically is situated fairly close to the outer face of the plug. The elastomer seal is far less likely to be damaged during installation of the plug than if it were mounted at the inner end of the plug. At the same time, however, as a practical matter the minimum tolerances required for manageable insertion of the plug also allow particulates in the frac fluid to become lodged between the plug and access bore. The accumulation of particulates can make it more difficult to remove the plug and can damage the access bore and the plug as the plug is removed.

In contrast, the reduced diameter portion 194 of novel suction plug 190 creates an annular clearance between the inner end of suction plug 190 and access bore 146. That clearance preferably is somewhat larger than the majority of the particulates commonly used in frac fluids. Thus, although particulates can be driven into the clearance, individual particles are less likely to become lodged therein. They may be washed out or more easily dislodged during removal of suction plug 190 with less damage to suction plug 190 and access bore 146.

Figure 24:
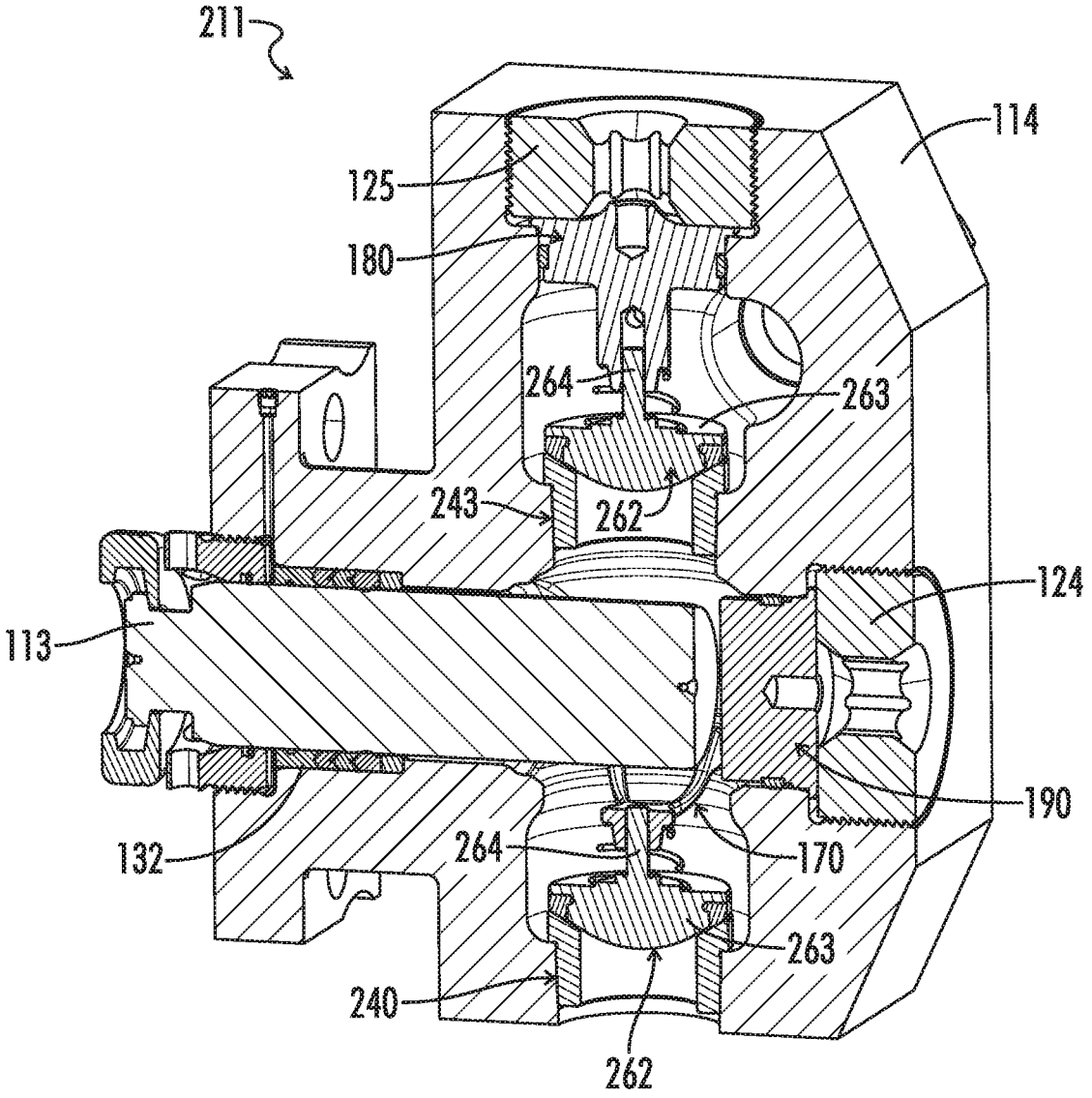
FIG. 24 is an isometric, transverse cross-sectional view of a second preferred embodiment 211 of the frac pump fluid ends of the subject invention, which novel fluid end 211 is identical to novel fluid end 111 except that it incorporates a valve body 262 instead of valve body 162.
Figure 25:
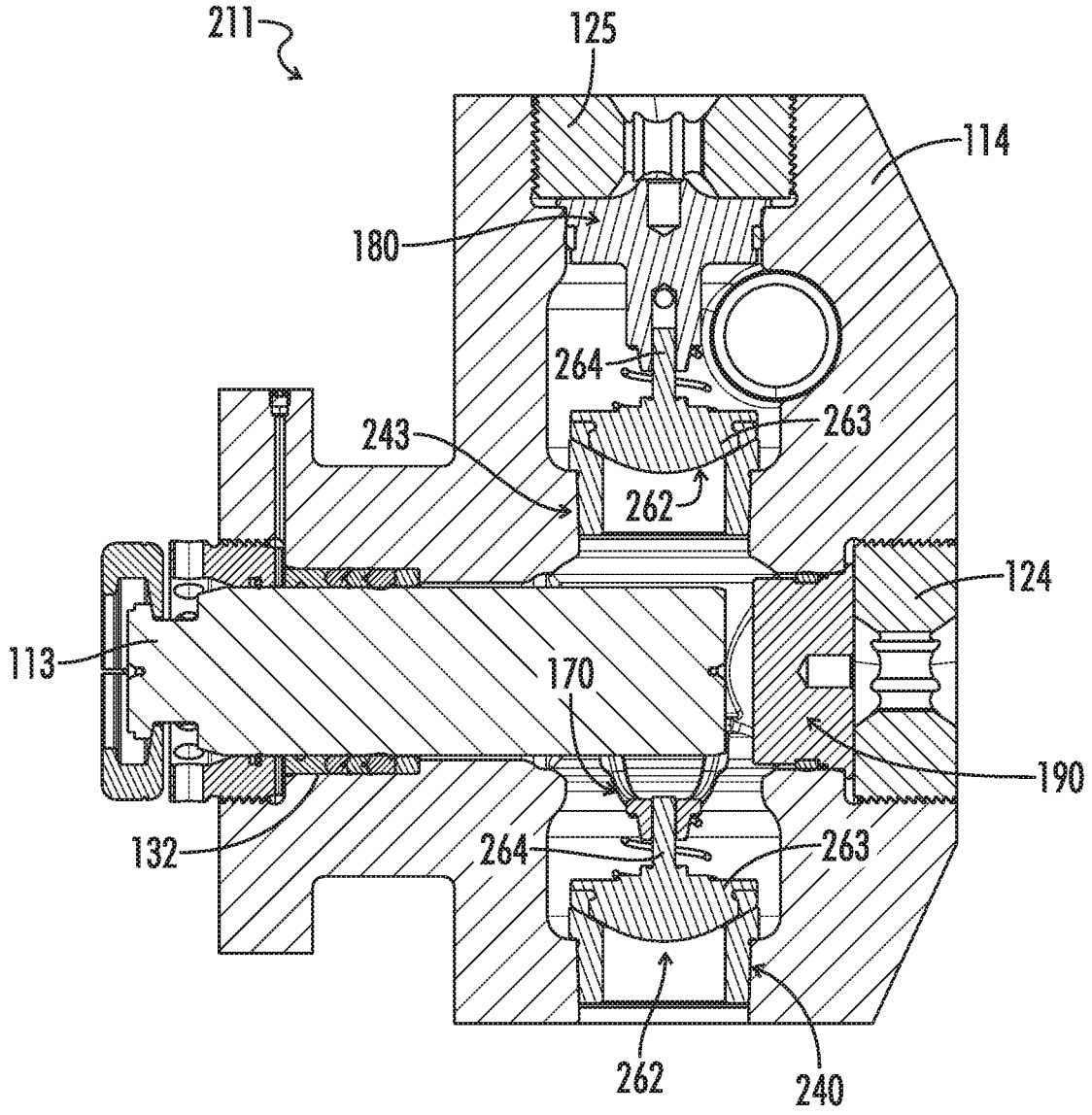
FIG. 25 is a transverse cross-sectional view of novel fluid end 211.

Other advantages of the novel suction valve retainers may be appreciated best by reference to a second preferred embodiment 211 of the novel fluid ends. Fluid end 211 is shown in FIGS. 24-25. Fluid end 211 is identical to fluid end 111 except that suction valve 240 and discharge valve 243 incorporate a different valve body 262. Valve body 262, like valve body 162 in fluid end 111, is of conventional design. Instead of legs 164 extending down from head 163, however, valve body 262 has a stem 264 that extends upward from the center of a head 263. When they are installed in fluid end 211, stem 264 of valve body 262 in suction valve 240 extends into passage 175 of suction valve retainer 170. Stem 264 of valve body 262 in discharge valve 243 extends into passage 185 of discharge plug 180. Passages 174/185 guide movement of valve body 262 as suction valve 240 and discharge valve 243 open and shut during operation of the pump. Transverse port 186 in post 183 of discharge plug 180 allows fluid to circulate into and out of passage 185 as discharge valve 243 opens and closes.

It will be appreciated, therefore, that novel suction valve retainer 170 and novel discharge plug 180 can accommodate both common styles of valve bodies as reflected in valve bodies 162 and 262. Moreover, they can do so with the same springs 177/187. Conventional fluid ends cannot accommodate both types of valve bodies without also changing out the suction valve retainer, the discharge plug, and their associated springs. The valves in frac pumps are consumables which necessarily must be replaced fairly often. The novel fluid ends, therefore, offer the prospect of easier, more economical servicing.

In general, the various components of the novel fluid ends may be fabricated by methods and from materials commonly used in manufacturing conventional fluid ends for frac pumps. Given the extreme stress and the corrosive and abrasive fluids to which they are exposed, suitable materials will be hard, strong, and durable. For example, excepting elastomeric seals, packings, and the like, the components of novel fluid ends may be fabricated from 4130 and 4140 chromoly steel or from somewhat harder, stronger steel such as 4130M7, high end nickel alloys, and stainless steel. The components may be made by any number of conventional techniques, but typically and in large part will be made by forging, extruding, or mold casting a blank part and then machining the required features into the part.

It also will be appreciated that various improvements to fluid ends in general, and to the fluid end block, the suction valve retainers, the discharge plugs, and suction plugs incorporated therein, have been described herein. Preferably, the novel pumps will incorporate all or most such improvements. At the same time, however, the invention encompasses embodiments where only one, or fewer than all such improvements are incorporated. The novel pumps also will incorporate various features of conventional frac pumps and fluid ends. For example, the exemplified pumping units of the novel fluid ends have been described as incorporating various conventional valve bodies, seats, seals, and packing elements. Other conventional features, however, may be incorporated into the novel valves as will be readily appreciated by workers in the art having the benefit of this disclosure.

Similarly, the novel pumps have been described in the context of frac systems. While frac systems in particular, and the oil and gas industry in general rely on high-pressure pumps, the novel pumps are not limited to such applications or industries. Likewise, the improvements disclosed herein are not limited in their application to the specific, exemplified conventional pump designs. Suffice it to say that the improvements and novel pumps disclosed herein have wide applicability wherever high-pressure pumps have been applied conventionally.

While this invention has been disclosed and discussed primarily in terms of specific embodiments thereof, it is not intended to be limited thereto. Other modifications and embodiments will be apparent to the worker in the art.

What is claimed is:

1. A fluid end block for a reciprocating frac pump, said fluid end block comprising:

(a) a plunger cylinder having a primary axis;

(b) a suction bore having a primary axis;

(c) a discharge bore; and (d) a pump chamber, said pump chamber i) being defined by the intersection of said plunger cylinder, said suction bore, and said discharge bore;

ii) having a cylindrical portion extending along said primary axis of said suction bore, said cylindrical portion having a diameter greater than the diameter of said plunger cylinder; and iii) having an integral ridge, said ridge extending radially inward from the walls of said pump chamber in a plane normal to said suction bore primary axis.

2. The fluid end block of claim 1, wherein said fluid end block comprises an access bore intersecting with said pump chamber and wherein said ridge comprises a pair of semi-annular ridges extending between the intersections of said plunger cylinder and said access bore with said pump chamber.

3. The fluid end block of claim 2, wherein said ridge is provided in said cylindrical portion of said pump chamber.

4. The fluid end block of claim 3, wherein said ridge is in the lower portion of said cylindrical portion of said pump chamber.

5. The fluid end block of claim 4, wherein said ridge has an external radius at its apex, an internal radius at its base, and flats extending between said apex and base radii.

6. The fluid end block of claim 5, wherein said ridge is adapted to provide a stop for a suction valve retainer.

7. A fluid end for a reciprocating frac pump, said fluid end comprising the fluid end block of claim 6.

8. The fluid end block of claim 4, wherein said ridge is adapted to provide a stop for a suction valve retainer.

9. A fluid end for a reciprocating frac pump, said fluid end comprising the fluid end block of claim 4.

10. The fluid end block of claim 2, wherein said ridge has an external radius at its apex, an internal radius at its base, and flats extending between said apex and base radii.

11. The fluid end block of claim 2, wherein said ridge is adapted to provide a stop for a suction valve retainer.

12. A fluid end for a reciprocating frac pump, said fluid end comprising the fluid end block of claim 2.

13. The fluid end block of claim 1, wherein said ridge is provided in said cylindrical portion of said pump chamber.

14. The fluid end block of claim 1, wherein said ridge is in the lower portion of said cylindrical portion of said pump chamber.

15. A fluid end for a reciprocating frac pump, said fluid end comprising the fluid end block of claim 4.

16. The fluid end block of claim 1, wherein said ridge has an external radius at its apex, an internal radius at its base, and flats extending between said apex and base radii.

17. The fluid end block of claim 1, wherein said ridge is adapted to provide a stop for a suction valve retainer.

18. A fluid end for a reciprocating frac pump, said fluid end comprising the fluid end block of claim 1.

19. The fluid end of claim 18, wherein said fluid end comprises a suction valve retainer, said retainer adapted for installation within said pump chamber of said fluid end block and comprising:

(a) a center portion adapted to engage a spring extending from a suction valve body of said pump;

(b) a lug extending downward from said center portion, said lug adapted to position said spring on said retainer center portion;

(c) a passage extending from the bottom of said lug upwards along a central axis of said retainer, said passage adapted to accommodate a valve stem;

(d) a pair of arms extending radially away and upwards from opposite sides of said center portion; said arms having an arcuate bearing surface adapted to bear upwards on said ridge in said pump chamber when said spring is under compression.

20. A reciprocating frac pump, said pump comprising the fluid end of claim 1.

* * * * *